US012330019B2

(12) United States Patent
Ellis

(10) Patent No.: US 12,330,019 B2
(45) Date of Patent: Jun. 17, 2025

(54) UPPER AND LOWER BODY RECIPROCATING ARCING MOTION EXERCISE MACHINE WITH AN ADJUSTABLE ANGLE USER SUPPORT

(71) Applicant: Product Design Innovations, LLC, Ocala, FL (US)

(72) Inventor: Joseph K. Ellis, Ocala, FL (US)

(73) Assignee: Product Design Innovations, LLC, Ocala, FL (US)

( * ) Notice: Subject to any disclaimer, the term of this patent is extended or adjusted under 35 U.S.C. 154(b) by 69 days.

(21) Appl. No.: 18/490,118

(22) Filed: Oct. 19, 2023

(65) Prior Publication Data

US 2024/0042272 A1 Feb. 8, 2024

Related U.S. Application Data

(63) Continuation-in-part of application No. 17/507,634, filed on Oct. 21, 2021, now Pat. No. 11,794,066, (Continued)

(51) Int. Cl.
*A63B 23/035* (2006.01)
*A63B 21/00* (2006.01)

(52) U.S. Cl.
CPC ..... *A63B 23/0355* (2013.01); *A63B 21/4034* (2015.10); *A63B 21/4035* (2015.10); (Continued)

(58) Field of Classification Search
CPC ..... A63B 23/0355; A63B 21/4034; A63B 21/4035; A63B 21/4045; A63B 23/03533; A63B 2225/093; A63B 21/068; A63B 2022/206; A63B 2208/0219; A63B 2208/0295; A63B 22/001; A63B 22/0023; A63B 22/203; A63B 22/205; A63B 21/225; A63B 21/4039; A63B 21/157; A63B 21/012; A63B 21/00192; A63B 21/0058; A63B 21/0084; A63B 21/0088; (Continued)

(56) References Cited

U.S. PATENT DOCUMENTS 4,848,737 A 7/1989 Ehenfield
5,370,594 A 12/1994 Grinblat
(Continued)

*Primary Examiner* — Nyca T Nguyen
(74) *Attorney, Agent, or Firm* — Laurence P. Colton; Smith Tempel Blaha LLC

(57) ABSTRACT

An upper and lower body reciprocating arcing motion exercise machine with an adjustable angle user support frame, left and right lower body user support assemblies having foot platforms and shin support pads mounted on an arcing track for movement along rearward and central portions of the user support frame, and left and right upper body user supports having gripping handles mounted on pivotable levers that move in an arcing motion relative to a forward and central portion of the movable user support frame. A linkage assembly operatively connects and synchronizes the exercise motions of the upper and lower body user support assemblies. In certain embodiments, an adjustable resistance mechanism is operatively engaged with the upper and lower body user supports for providing adjustable resistance to the exercise motion of the upper and lower body user supports.

14 Claims, 13 Drawing Sheets

Related U.S. Application Data which is a continuation-in-part of application No. 16/876,239, filed on May 18, 2020, now Pat. No. 11,524,206, which is a continuation-in-part of application No. 15/848,656, filed on Dec. 20, 2017, now Pat. No. 10,653,914, which is a continuation-in-part of application No. 14/840,776, filed on Aug. 31, 2015, now Pat. No. 9,873,016.

(52) U.S. Cl.
CPC .... *A63B 21/4045* (2015.10); *A63B 23/03533* (2013.01); *A63B 2225/093* (2013.01)

(58) Field of Classification Search
CPC .. A63B 21/4033; A63B 23/035–03591; A63B 22/20–208
See application file for complete search history.

(56) References Cited

U.S. PATENT DOCUMENTS

| | | | |
|---|---|---|---|
| 5,518,483 | A | 5/1996 | Oswald |
| 5,554,086 | A | 9/1996 | Habing |
| 5,569,132 | A | 10/1996 | Wu |
| 5,580,340 | A | 12/1996 | Yu |
| 6,264,588 | B1 | 7/2001 | Ellis |
| 6,287,241 | B1 | 9/2001 | Ellis |
| 6,361,476 | B1 | 3/2002 | Eschenbach |
| 7,104,933 | B1 | 9/2006 | Liao |
| 7,220,221 | B2 | 5/2007 | Moismann |
| 7,232,404 | B2 | 6/2007 | Nelson |
| 7,244,217 | B2 | 7/2007 | Rodgers, Jr. |
| 7,335,140 | B2 | 2/2008 | Webber |
| 7,455,633 | B2 | 11/2008 | Brown |
| 7,585,263 | B2 | 9/2009 | Brown |
| 7,594,880 | B2 | 9/2009 | Webber |
| 7,611,446 | B2 | 11/2009 | Chuang |
| 7,662,076 | B1 | 2/2010 | Ho |
| 7,727,128 | B2 | 6/2010 | Gianneli |
| 7,731,638 | B2 | 6/2010 | Webber |
| 7,780,585 | B1 | 8/2010 | Rivas |
| 7,833,143 | B1 | 11/2010 | Tsai |
| 7,867,149 | B1 | 1/2011 | Webber |
| 7,963,890 | B2 | 6/2011 | Webber |
| 8,025,609 | B2 | 9/2011 | Gianneli |
| 8,162,807 | B1 | 4/2012 | Webber |
| 8,172,732 | B1 | 5/2012 | Webber |
| 8,317,665 | B2 | 11/2012 | Webber |
| 8,888,661 | B2 | 11/2014 | Ellis |
| 9,155,933 | B2 | 10/2015 | Ching-Yu |
| 9,649,529 | B1 | 5/2017 | Miller |
| 2002/0013199 | A1 | 1/2002 | Gianneli |
| 2002/0019298 | A1 | 2/2002 | Eschenbach |
| 2005/0148438 | A1 | 7/2005 | Carlsen |
| 2005/0159274 | A1 | 7/2005 | Chen |
| 2009/0247370 | A1 | 10/2009 | Stearns |
| 2010/0048367 | A1 | 2/2010 | Kiang |
| 2010/0311555 | A1 | 12/2010 | Campanaro |
| 2011/0028283 | A1 | 2/2011 | Webber |
| 2013/0331238 | A1 | 12/2013 | Ellis |
| 2015/0182787 | A1 | 7/2015 | Liu |
| 2015/0283425 | A1 | 10/2015 | Zhou |
| 2015/0343250 | A1 | 12/2015 | Lagree |
| 2016/0213970 | A1 | 7/2016 | Eschenbach |
| 2017/0157460 | A1 | 6/2017 | Lin |
| 2017/0296865 | A1 | 10/2017 | Lagree |
| 2020/0276471 | A1* | 9/2020 | Ellis ..... A63B 21/4034 |
| 2024/0123279 | A1* | 4/2024 | Ellis ..... A63B 69/0062 |

* cited by examiner

UPPER AND LOWER BODY RECIPROCATING ARCING MOTION EXERCISE MACHINE WITH AN ADJUSTABLE ANGLE USER SUPPORT

STATEMENT OF RELATED APPLICATIONS

This patent application claims priority on and the benefit of U.S. patent application Ser. No. 17/507,634 having a filing date of 21 Oct. 2021, now U.S. patent Ser. No. 11/794,066 B2 having an issue date of 24 Oct. 2023, which claims priority on and the benefit of U.S. patent application Ser. No. 16/876,239 having a filing date of 18 May 2020, now U.S. patent Ser. No. 11/524,206 B2 having an issue date of 13 Dec. 2022, which claims priority on and the benefit of U.S. patent application Ser. No. 15/848,656 having a filing date of 20 Dec. 2017, now U.S. patent Ser. No. 10/653,914 B2 having an issue date of 19 May 2020, which claims priority on and the benefit of U.S. patent application Ser. No. 14/840,776 having a filing date of 31 Aug. 2015, now U.S. Pat. No. 9,873,016 B2 having an issue date of 31 Aug. 2015.

BACKGROUND OF THE INVENTION

Technical Field

This invention relates to the general technical field of physical fitness and exercise equipment and machines. This invention relates more specifically to the field of exercise equipment for concurrently exercising the user's upper and lower body at multiple angles of reciprocating arcing motions.

Prior Art

Exercise, physical fitness, and physical therapy equipment and machines are available in various configurations and for various purposes, and are available for all of the major muscle groups. In the general exercise equipment field, there are generally two categories of machines. One category of machines commonly known as strength or anaerobic training machines are generally geared towards lower repetition, shorter duration, and higher resistance exercises and there are many configurations of strength training machines that exercise a specific muscle group or set of muscle groups. A second category commonly known as cardiovascular or aerobic training machines are generally geared towards longer duration, lower resistance, and higher repetition exercises. A third category of products that is increasing in popularity are machines that allow a user to stretch their skeletal musculature and to do so from various angles. Stretching prior to exercising is proven to help prevent injuries.

There are many configurations of cardiovascular training machines that exercise a specific muscle group or set of muscle groups such as treadmills, stationary bicycles, stair climbing machines, ladder climbing machines, elliptical striding machines, arcing strider machines, and other specialized machines. Most of these products produce a single exercise motion such as climbing, running, or bike riding that only engage a certain group of muscles. A treadmill, for example, can change the elevation of the running surface to create some exercise variety, but it is engaging the user's lower body only and the user is weight bearing through their legs only regardless of the elevation of the running surface.

Most of the other aforementioned products operate with a fixed frame to create exercise motions in a single plane.

Many of the aforementioned products also incorporate a circular crank into the mechanical function of the machine causing all users regardless of their size, flexibility, or physical capabilities to follow a fixed pattern of motion that prevents the user from controlling the range of motion of the exercise function of the machine. All of the aforementioned products also cause the user to weight bear through either a sitting or standing position, which also reduces the exercise variety and muscle groups engaged. Each of these deficiencies limits the effectiveness of the exercise function of these products.

Many machines have been developed that engage a user's upper and lower body into an exercise motion, but each of these previous machines have deficiencies as previously described herein. U.S. Pat. No. 6,361,476 of Eschenbach discloses an "Elliptical Exercise Striding Machine" with individual left and right foot pedals, each movably mounted to and dependently connected by an adjustable rotational crank arm assembly proximal to a first end and supported by either a rolling wheel or pivoting handle linkage proximal to a second end. During operation of the machine, the foot pedals move dependently in a rotating ellipse with a closed loop range of motion and can be adjusted in stride length and the shape or motion pattern of the elliptical motion can be adjusted. The left-side foot pedals and handles and right-side foot pedals and handles are dependently connected in opposing positions of the range of motion and move in unison. This closed loop range of motion of the elliptical pattern requires the user to follow the machines complete range of motion requiring the range of motion to be adjustable to fit various size users with various capabilities adding additional components, including wear components, to the cost of the machine. This closed loop motion also creates momentum that decreases the force required by the user to keep the machine moving, thus reducing the user's exertion level and effectiveness of the exercise motion. Furthermore, during operation of this machine the user is weight bearing in a standing position only, which limits the variation of muscle group engagement.

U.S. Pat. No. 8,025,609 of Giannelli et al. discloses a "Striding Exercise Machine" comprising a pair of pivotally supported individual foot pedals that are dependently linked together through a rotational crank assembly and move in unison in a back and forth fixed range of motion arcuate path with the arcuate path being adjustable to a selected segment. The apparatus includes handles or arms interconnected or interlinked to the foot pedals for upper body pushing or pulling energy input. The handles or arms pivot together with and in the same back and forth direction as the pedals to which they are inter-linked, and the left-side pedals and arms are in an opposing position of the range of motion as the right said pedals and arms. The motions of the pedals and handles or arms are controlled by a circular rotating crank linkage assembly. This closed loop range of motion of the elliptical pattern requires the user to follow the machine linkage's complete circular range of motion requiring the range of motion to be adjustable to fit users of various sizes and capabilities. Adding this adjustment feature to the machine is costlier to produce and creates additional wear components. Furthermore, during operation of this machine the user is weight bearing in a standing position only which limits the variation of muscle group engagement.

US Patent Publication No. 2009/0247370 of Stearns et al. discloses an "Elliptical Striding Machine" comprising opposing left and right crank assemblies mounted to the base frame about a common axis. Left- and right-side foot support linkages are supported proximal to a first end by a movable rocker shaft that is mounted on opposing ends to the left- and right-side crank assemblies. Said left and right foot support linkages are operatively linked to and supported by left- and right-side handle bars that are pivotally mounted to an upper portion of the stationary frame. The rotating rocker support shaft and linkage assembly are configured such that the left foot support and left handle bar assembly are 180 degrees out of phase with the right foot support and right handle bar assembly such that the left- and right-side user engagement features are opposing in the range of motion of the machine and remain as such during operation of the machine. Left- and right-side draw bars are pivotally mounted at a first end to an upper portion of the stationary main frame and movably mounted at a second end to the left- and right-side crank assemblies such that the draw bars can be adjusted to alter the range of motion and shape of the elliptical motion of the foot pedal assemblies during operation of the machine. The motions of the left- and right-side foot support and handle bar assemblies are controlled by the closed loop circular rotating motion of the left- and right-side cranks and rocker shaft assembly such that the left- and right-side foot support assemblies are geometrically opposed along the shape of the elliptical motion path and remain that way during operation of the machine. This closed loop range of motion of the elliptical pattern requires the user to follow the machines complete range of motion requiring the range of motion to be adjustable to fit various size users with various capabilities and these additional components of the adjustment feature increase the cost of the machine and create additional wear components. Furthermore, during operation of this machine the user is weight bearing in a standing position only which limits the variation of muscle group engagement.

US Patent application publication No. 2015/0283425 of Zhou discloses an "Elliptical Prone Exerciser" machine that places a user in a prone crawling position. While this machine allows a user to weight bear with all four limbs, it utilizes a circular crank drive system connected to the upper body user supports and a separate circular crank drive system connected to the lower body user supports such that a user is required to follow a full close looped path of motion with their upper and lower body for each repetition. This prevents the user from controlling the range of motion of each exercise repetition, which limits the exercise variety and does not fit all size users without making multiple adjustments to the machine prior to operating the machine. Moreover, Zhou teaches a machine that requires output ends of both the upper body drive system and the lower body drive system to be connected with a central dampening wheel and the dampening wheel creates the resistance to the exercise motion. Therefore, the Zhou machine will not operate without a dampening resistance system. This limits the capabilities of the Zhou machine as being operated as a stretching apparatus. Also the closed loop pattern of motion greatly reduces the Zhou machine's capabilities from being operated as a stretching apparatus.

U.S. Pat. No. 9,155,933 of Ching-Yu discloses a "High Knees Exercise" machine that places the user in a seated weight bearing position for an exercise engagement of a user's legs only. A stationary seat is disposed on a station base frame. Left and right drive members are pivotally connected to the frame below the seat and positioned on either side of the seat to swing forward of the seat. Pedals are connected to the swinging ends of the left and right drive members. A linkage assembly connects the left and right drive members for leading the drive members in opposing motion relative to each another. While this machine allows the user to control the range of motion of the exercise motion provided by the machine, the user is weight bearing in a seated position only, very similar to a station bicycle, which limits the muscle groups engaged to certain parts of the legs and hips. Moreover, this machine operates with a fixed position frame such that the user can only exercise in one plane of motion.

An exercise machine that would greatly improve the efficiency and effectiveness of a workout regimen would concurrently engage the user's upper and lower body providing a natural and bio-mechanically correct reciprocating arcing motion wherein one arm pushes while the other arm pulls and one leg pushes while the other leg pulls to engage the maximum amount of skeletal musculature including the user's core into a single exercise motion. Such an improved machine would also allow the user's exercise motion to control the range of motion of the mechanical motion created by the exercise machine such that various size users could operate the machine comfortably without requiring any adjustments to the machine. Also, the exercise variety could be increased by using multiple ranges of motion based on the user's goal for a particular exercise regimen. Such an improved exercise machine could also be operated at various angles between horizontal and vertical to allow the user to exercise at a plurality of planes of motion and cause the user to weight bear at multiple angles with different portions of the user's body to create a greater variety of exercises and engage many more muscle groups to create a comprehensive total body workout. Moreover, if the mechanical features of such and improved exercise machine would allow the machine to operate without requiring a resistance mechanism, the machine could be utilized as a skeletal muscular stretching apparatus without the additional cost of an added resistance mechanism. The present invention provides just such an improved exercise machine as is further described herein.

BRIEF SUMMARY OF THE INVENTION

The present invention creates multiple arcing motion pushing and pulling exercises for the user's upper body and lower body that maximize a user's skeletal muscular engagement by adjusting the angle of the machine's user support frame to a plurality of angle positions from mostly vertical to mostly horizontal. The user support frame is elongated having a forward end and rearward end and is supported by a stationary base frame. The stationary base frame is an elongated structure having a front end and a back end.

In certain embodiments, the rearward portion of the user support frame rolls or slides along rearward and central portions of the stationary base frame when the forward and central section of the user support frame is lifted or lowered by an angle adjusting assembly that connects the forward or central portions of the user support frame to the forward portion of the stationary base frame. In other embodiments, a central portion of the user support frame is pivotally mounted on the stationary base frame such that the opposing ends of the user support frame can be lifted and lowered in opposing directions to adjust the user support frame to a plurality of exercise angles.

Mounted on the left side of the user support frame is a left side lower body user support assembly comprising a foot platform and shin support pad and a left side upper body user support assembly comprising a pivotable lever arm and a gripping handle. The left side lower body user support assembly and the left side upper body user support assembly are operatively connected such that the user's left leg and left arm can push in unison or pull in unison in opposing directions. Mounted on the right side of the user support frame is a right side lower body user support assembly comprising a foot platform and shin support pad and a right side upper body user support assembly comprising a pivotable lever and gripping handle. The right side lower body user support and the right side upper body user support are operatively connected such that the user's right leg and right arm can push in unison or pull in unison in opposing directions. The left side user support assemblies are operatively connected to the right side user support assemblies and when the left side user support assemblies perform a pulling or pushing motion, the right side user support assemblies concurrently perform the opposite motion.

The lower body user support assemblies roll along the central and rearward portions of the user support frame on arc shaped tracks and the upper body user support assemblies pivot about the central and forward portions of the user support frame such that a user's hands and feet move in concurrent fixed arcing paths of reciprocating pushing and pulling motions that are defined by the machine, but the range of the exercise motion is controlled by the user's exercise motion. The multiple angles of operation of the user support frame allow the user to exercise in multiple planes of motion to perform a variety of exercises including ladder climbing, stair climbing, hiking, running, crawling, and other exercises utilizing natural and bio-mechanically correct exercise motions.

In certain embodiments, the machine can be configured without a resistance mechanism for performing stretching exercises, physical therapy, and light cardiovascular training. In other embodiments, the machine can be configured with an adjustable resistance mechanism or assembly that cooperates with the lower body user support assemblies and the upper body user support assemblies such that the user can select a resistance level that creates the desired exercise exertion level.

BRIEF DESCRIPTION OF THE DRAWINGS

In some figures, the invention is illustrated from one side and in these figures the invention looks the same, but in a general mirror image from the opposite side, with both sides having same structures, features, and components. In some figures, certain components have been removed from the machine in order to better illustrate other components. In some figures, certain components have been illustrated with close up views for better illustration of the individual components and how these components cooperate during operation of the invention.

DETAILED DESCRIPTION OF PREFERRED EMBODIMENTS

Figure 1:
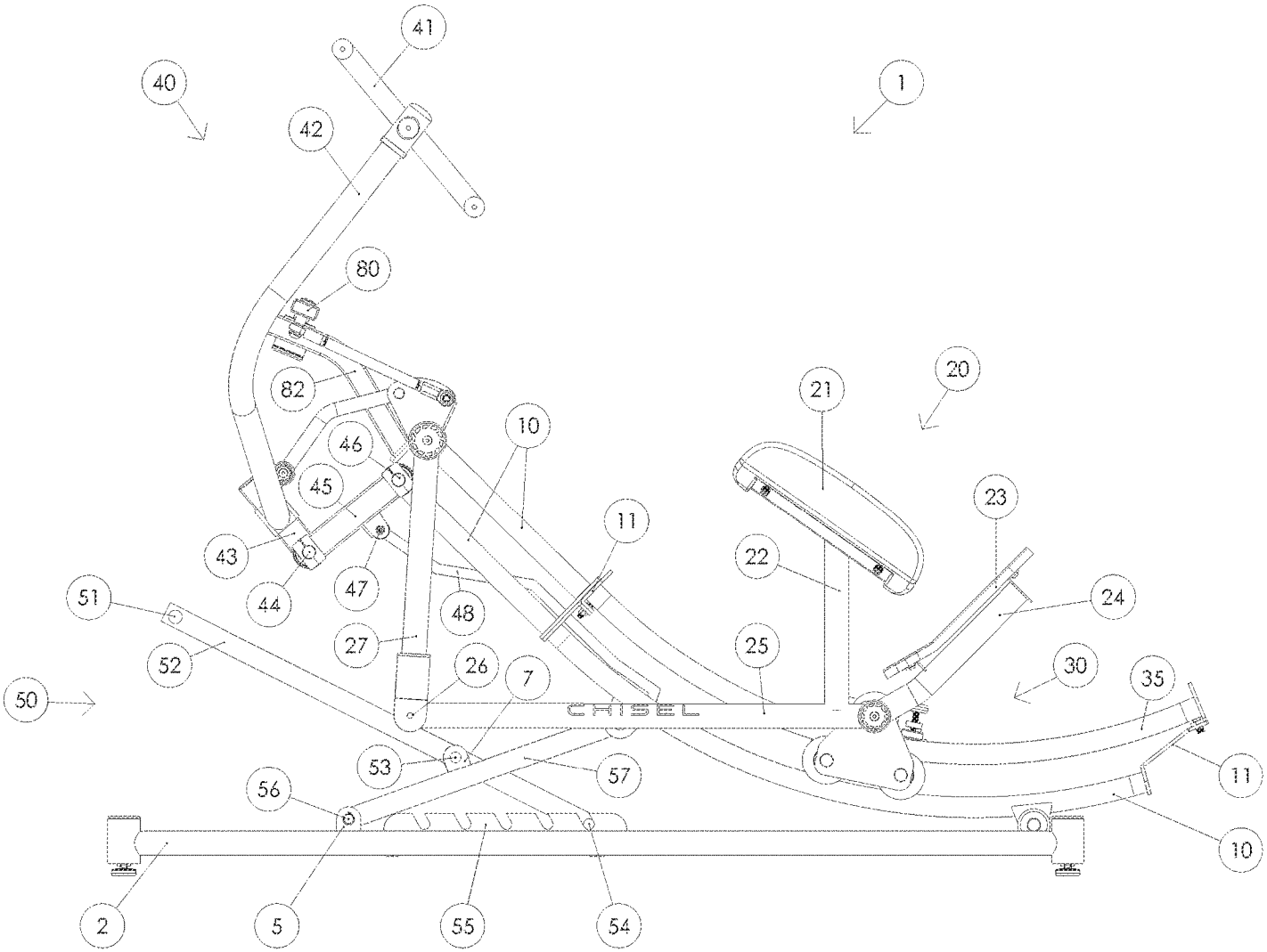
FIG. 1 is a left side view of a first embodiment of the invention in the lowest angle exercise position.

Exemplary preferred embodiments are disclosed below in connection with the attached drawings. Throughout this specification, various terms will be used to describe various components or sets of components, features or sets of features, mechanisms, and devices. The term "rearward end or portion" of the user support frame, machine, or stationary base frame will refer to the end or portion of each that is most proximal to the user's feet and distal to the user's hands. The term "forward end or portion" of the user support frame, machine, or stationary base frame will refer to the end or portion of each that is most proximal to the user's hands and distal to the user's feet. The term "linkage" or "linkage assembly" will refer to a movable component or group of components that joint two features of the machine wherein at least one of the features has a movable function. The terms "push", "pushing", "press", "pressing", "pull", or "pulling" when referring to the user operating the machine will be used to describe any motion or movement by a user when they are maintaining or increasing their exertion force. The term "upper body" will refer generally to the user's arms and hands but may also refer to the user's chest, back, and torso as well. The term "lower body" will generally refer to the user's legs and feet but may also refer to the user's buttocks and hips as well. The term "lower legs" will refer to the user's shin, ankles, and feet and in some instances the user's knees. The terms "limbs" or "extremities" will refer to the user's arms and legs. The term "angle adjusting assembly" will refer to any component and or mechanism and its components that adjust the angle of the user support frame. The term "pivot" will refer to an axle and or axle hub in which a component or set of components rotate upon. The term "assembly" will refer to a group of components that cooperate together to create a function of the invention.

The invention is comprised of many identical left and right components as illustrated in various perspective views and many of these components will be introduced as "left and right" or "left and right side" components and thereafter frequently be referred to and described in a plural context so as to prevent the excess duplication of descriptions of "left and right" or "left and right side" components. When referring to left and right identical components it is to be expressly understood that the term "left" would be referring to a user's left side when mounted on the machine in the exercise position and the term "right" would be referring to a user's right side when mounted on the machine in the exercise position. When a first set of like left and right components are referred to as being connected, engaged, or cooperating with a second and different set of like left and right components, it is to be expressly understood that those connections, engagements, or cooperations will be referring to the first left component connecting, engaging, or cooperating with the second and different left component the first right component connecting, engaging, or cooperating with second and different right component to prevent the excessive duplication of the term "respectively".

The exercise motion of the user's lower body created by the invention is virtually identical in all embodiments of the invention. The exercise motion of the user's upper body has slight variations among the embodiments. Each embodiment will function with or without an adjustable resistance mechanism. A first distinction between the embodiments is the mechanism and method for adjusting the user support frame and securing the angle of the user support frame to the stationary base frame. A second distinction between the embodiments is how the user support frame is supported by the stationary base frame. A third distinction between the embodiments is whether the upper body user support assemblies are operatively connected to the user support frame or the upper body user support assemblies are rigidly connected directly to the lower body user support assembly.

To further comply with written description and enablement requirements, the following patents and patent application publications are also incorporated herein by this reference in their entirety. U.S. Pat. Nos. 9,155,933, 10,065,062, 10,994,169, and US Patent Application Publication 2015/0283425.

FIGS. 1-13 are all views of embodiments of the invention this inventor refers to as "An upper and lower body reciprocating arcing motion exercise machine with an adjustable angle user support". Generally, the invention is a machine for concurrently pushing with the user's left side arm and left side leg while concurrently pulling with the user's right side arm and right side leg and vice versa in a reciprocating arcing motion wherein the user controls the range of the exercise motion. The user supports are operatively connected by a linkage assembly and operate in unison such that movement of any of the user support components will concurrently move all of the user support components. All of the exercise motion components of the machine are mounted on an adjustable angle user support frame that is supported by a stationary base frame such that the user support frame is adjustable in angle relative to the stationary base frame and the floor surface upon which the stationary base frame rest. In certain embodiments the user support frame is pivotally and rollably engaged with the stationary base frame. In another embodiment, the user support is pivotally engaged with the stationary base. In certain embodiments the machine does not require a resistance mechanism and is operated to perform stretching exercises, physical therapy, and light cardiovascular training. In other embodiments the machine requires a resistance mechanism for performing higher exertion exercises.

FIGS. 1-5, illustrate various views of a first embodiment of the invention, namely machine 1, to provide a more complete understanding of the invention, wherein a rectangular shaped stationary base frame 2 contacts the floor surface as a base support for machine 1. Rigidly mounted on the rearward and central portions of the stationary base frame 2 are left and right linear wheel tracks 3. An angle adjustment linkage assembly 50 is pivotally mounted on a forward portion of stationary base frame 2 and pivotally connected to a forward portion of a user support frame 10. A rearward portion of user support frame 10 is rollably engaged with left and right linear wheel tracks 3. A set of left and right arc shaped foot pedal wheel tracks 35 are mounted on the rearward and central portions of user support frame 10. Left and right side lower body user support assemblies 20, designated as left side lower body user support assembly 20A and right side lower body user support 20B, are pivotally connected to a forward portion of user support frame 10 and rollably connected to foot pedal wheel tracks 35 with foot pedal transport assembly 30. Left and right side upper body user support assemblies 40, designated as left side upper body user support 40A and right side upper body user support 40B, are mounted on the forward end of user support frame 10. A user supports linkage assembly 70 operatively connects the left side lower body user support assembly 20A to the left side upper body user support assembly 40A and operatively connects the right side lower body user support assembly 20B to the right side upper body user support assembly 40B. A rocker arm 80 operatively connects the left side lower body user support assembly 20A and the left side upper body user support assembly 40A with the right side lower body user support assembly 20B and the right side upper body user support assembly 40B. An optional adjustable resistance mechanism 60 can be operatively engaged with the motion of the user support assemblies for creating resistance to the exercise motion.

Figure 2:
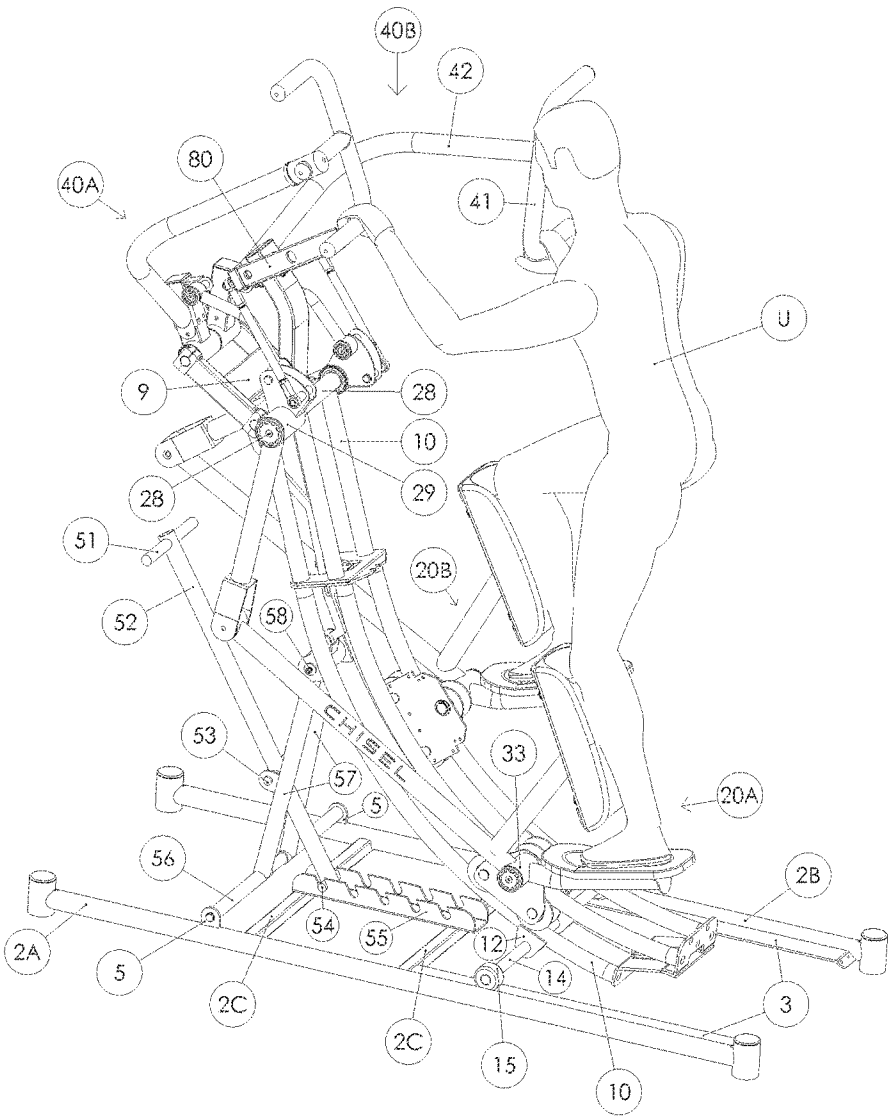
FIG. 2 is a perspective view of the first embodiment of the invention in the highest angle exercise position with a user mounted on the machine.

FIGS. 1 and 2 best illustrate the stationary base frame 2. Stationary base frame 2 is represented as a rectangular shaped structure made of elongated rigid left and right side tubes 2A, 2B that span the long side of the structure. The center and forward portions of the side tubes 2A, 2B are joined and braced across the narrower width with rigid cross tubes 2C. Left and right linear wheel tracks 3 are rigidly connected along the rearward and central portions of the long side tubes 2B, 2B of stationary base frame 2. Stationary base frame 2 can be configured differently as long as it is capable of supporting the weight and function of machine 1 plus a user U.

Figure 3:
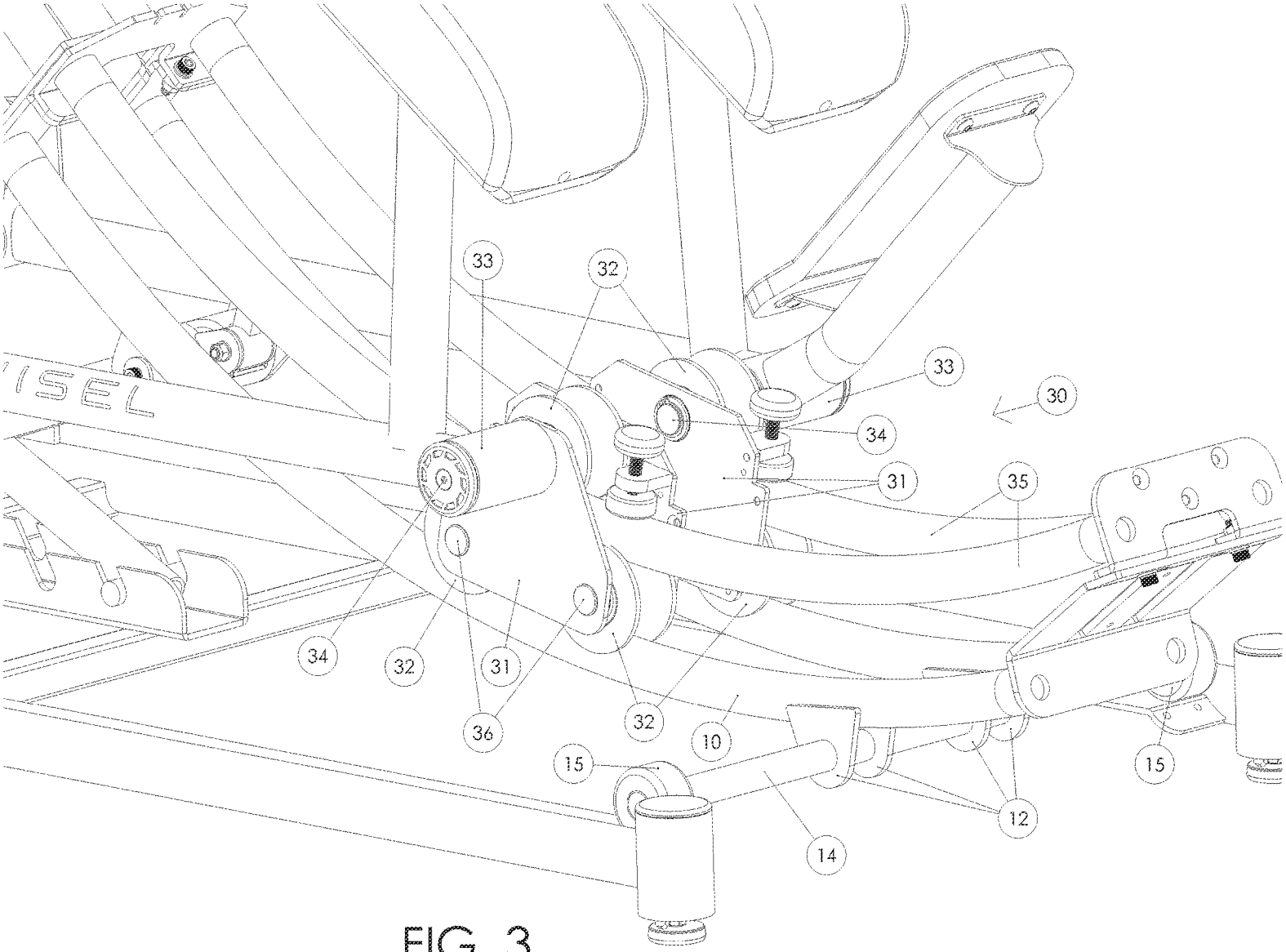
FIG. 3 is a closeup view of the foot pedal transport assemblies.

FIGS. 1-3 best illustrate user support frame 10. User support frame 10 is an elongated arc shaped structure that houses the functional exercise features of machine 1. A rearward portion of user support frame 10 is rollably engaged with a rearward and central portion of stationary base frame 2 wherein a plurality of axle connection plates 12 rigidly connect a rearward portion of user support frame 10 with user support frame axle 14. Left and right angle adjustment wheels 15 are operatively connected to opposing left and right ends of user support frame axle 14 and angle adjustment wheels 15 are rollably engaged with left and right linear wheel tracks 3. Rearward and forward portions of user support frame 10 are rigidly connected to left and right foot pedal wheel tracks 35 with connection brackets 11. A forward portion of user support frame 10 is pivotally connected to angle adjustment linkage assembly 50 with a pivot 58. The forward lower end of user support frame 10 is operatively connected to left and right upper body user support assemblies 40A, 40B with pivot axle 46. A forward central end of user support frame 10 is rigidly connected to rocker arm support tube 81 which houses rocker arm 80. A pivot axle 28 is rigidly connected to a forward upper end of user support frame 10 for operatively connecting left and right lower body user support assemblies 20 to user support frame 10.

Figure 5:
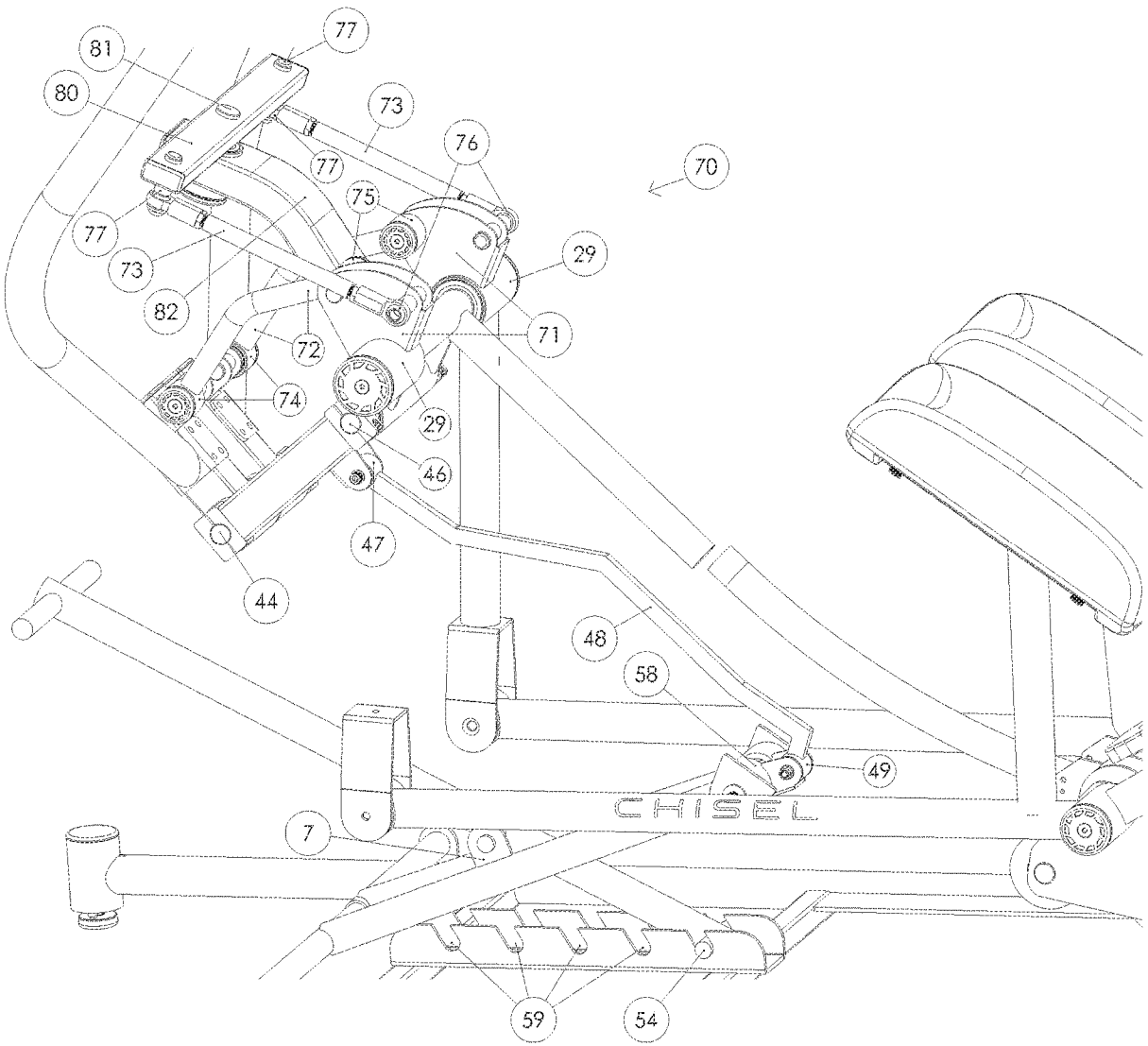
FIG. 5 is a closeup view of the user supports linkage assemblies, the rocker arm, a portion of the components of the upper body user support assemblies, and a portion of the components of the angle adjustment linkage assembly of a first embodiment of the invention.

FIGS. 1, 2, and 5 best illustrate angle adjustment assembly 50. Left and right axle mounting flanges 5 are rigidly connected in opposing positions to a forward portion of stationary base frame 2. Opposing ends of a pivot axle 56 are operatively mounted on left and right axle flanges 5 and the first ends of left and right angle control levers 57 are rigidly connected to a central portion of pivot axle 56. The second ends of left and right angle control levers 57 are rigidly connected to pivot 58 and pivot 58 is mounted on a forward portion of user support frame 10. A locking rack 55 is configured as an elongated U shaped rack comprised of a plurality of upward facing opposing left and right locking pin receiver slots 59. Locking rack 55 is rigidly mounted on the stationary base frame 2 perpendicular to pivot axle 56 and rearward of pivot axle 56.

Left and right axle mounting flanges 7 are rigidly mounted on a central portion of left and right angle control levers 57. Opposing ends of a pivot axle 53 are operatively mounted on left and right mounting flanges 7, and mounting flanges 7 are rigidly connected to central portions of angle control levers 57. Pivot axle 53 is rigidly connected perpendicular to a central portion of an angle adjustment lever 52. An angle adjustment handle 51 is rigidly mounted on a first end of angle adjustment lever 52 and a locking pin 54 is rigidly mounted on a second end of angle adjustment lever 52 such that the second end of angle adjustment lever 52 and locking pin 54 form a T shape. An angle of exercise position of user support frame 10 is selected and secured by operating angle adjustment assembly 50 and engaging locking pin 54 with a locking pin receiver slot 59.

FIG. 3 best illustrates foot pedals transport assembly 30. Foot pedals transport assembly 30 comprises left and right sets of three foot pedal wheels 32 arranged in a triangular configuration to roll along left and right foot pedal wheel tracks 35. Each set of three foot pedal wheels are mounted in a left and right housing 31. Each housing 31 is represented as two flat plate structures that may also house portions of an adjustable resistance assembly. Upper foot pedal wheels 32 form the top of the triangular wheel arrangement and are load bearing. Upper foot pedal wheels 32 engage the upper portions of foot pedal wheel tracks 35. Upper foot pedal wheels 32 rotate on left and right pivot hub axles 34. Pivot hub axles 34 are rigidly mounted in left and right pivot hubs 33. Left and right lower foot pedal wheels 32 engage the lower portions of foot pedal wheel tracks 35 and are non-weight bearing guide wheels that keep foot pedals transport assembly 30 secured to foot pedal wheel tracks 35 during operation of machine 1. Left and right lower foot pedal wheels 32 are secured to housings 31 with axles 36.

FIGS. 1 and 2 best illustrate left and right lower body user support assemblies 20, comprising left and right foot pedal support tubes 24 wherein the first ends of foot pedal support tubes 24 are rigidly connected at a perpendicular angle to the rearward portion of left and right pivot hubs 33. Left and right foot pedals 23 are rigidly connected to the upper portion of pedal support tubes 24. The first ends of left and right link bars 25 are connected to the forward portion of left and right pivot hubs 33 at a perpendicular angle opposing foot pedal support tubes 24. The first ends of left and right shin pad support tubes 22 are rigidly connected at a perpendicular angle proximal to the first ends of link bars 25 and the second end of shin pad support tubes are rigidly connected to a central portion of left and right shin pads 21. Left side foot pedal support tube 24, left side link bar 25, and left side shin pad support tube 22 are aligned in a similar plane such that left side shin pad 21 and left side foot pedal 23 are in alignment to receive a user U's left shin and left foot. Right side foot pedal support tube 24, right side link bar 25, and right side shin pad support tube 22 are aligned in a similar plane such that right side shin pad 21 and right side foot pedal 23 are in alignment to receive a user U's right shin and right foot. The second ends of left and right side link bars 25 are pivotally connected to the first ends of left and right side link bars 27 with a left and right side pivot 26. The second ends of left and right side link bars 27 are pivotally connected to user support frame 10 at opposing ends of pivot axle 28 with left and right side connection hubs 29.

FIGS. 1, 2, and 5 best illustrate left and right upper body user support assemblies 40, comprising left and right gripping handles 41 that are rigidly connected to first ends of left and right pivotable levers 42. The second ends of left and right pivotable levers 42 are rigidly connected to the central portions of left and right mounting tubes 43 and the first ends of left and right mounting tubes 43 are pivotally connected to the first ends of left and right height adjustment levers 45 with opposing ends of pivot axle 44. The second ends of height adjustment levers 45 are pivotally connected to user support frame 10 with opposing ends of pivot axle 46. Opposing ends of a connection tube 9 are rigidly connected with central portions of left and right side height adjustment levers 45. A first end of a height control bar 48 is pivotally connected a lower central portion of connection tube 9 with pivot 47 and a second end of height control bar 48 is pivotally connected to an upper portion of pivot 58 with pivot 49.

FIGS. 1, 2, and 5 best illustrate rocker arm 80 which is pivotally mounted on rocker arm support tube 82 with pivot 81. Opposing ends of rocker arm 80 have pivoting connections that are operatively connected with user supports linkage assembly 70.

FIGS. 1, 2, and 5 best illustrate user supports linkage assembly 70 comprising left and right connection hub flanges 71 that are rigidly mounted on left and right connection hubs 29. The first ends of left and right link bars 73 are pivotally connected to rearward portions of left and right connection hub flanges 71 with left and right pivots 76 and the second ends of left and right link bars 73 are pivotally connected to opposing ends of rocker arm 80 with left and right pivots 77. The first end of left and right link bars 72 are pivotally connected to forward portions of left and right connection hub flanges 71 with pivots 75 and the second end of left and right link bars 72 are pivotally connected to the second ends of left and right mounting tubes 43 with left and right pivots 74.

Figure 4:
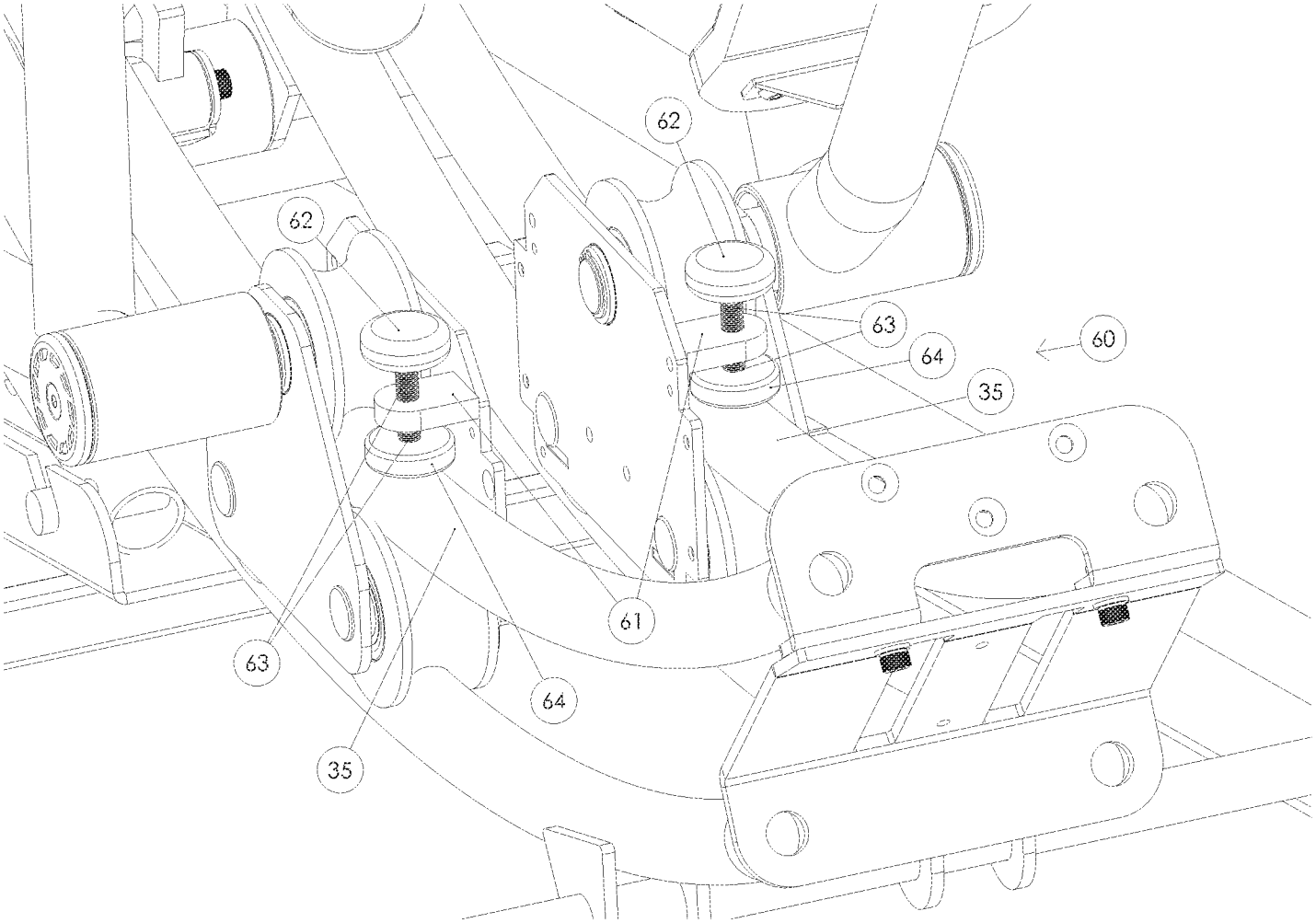
FIG. 4 is a closeup view of the adjustable resistance mechanism.

FIGS. 3 and 4 best illustrate adjustable resistance assembly 60, comprising left and right resistance mounting brackets 61 that are rigidly connected to a rearward portion of left and right housings 31. A central portion of left and right resistance mounting brackets 61 comprise a threaded through hole for receiving left and right resistance adjustment screws 63. Central portions of left and right resistance adjustment screws 63 are operatively engaged with threaded through holes in mounting brackets 61. Left and right resistance adjustment knobs 62 are rigidly connected to a first end of left and right resistance adjustment screws 63. Upper portions of left and right resistance friction pads 64 are rigidly connected with the second ends of left and right resistance adjustment screws 63 and lower portions of left and right resistance friction pads 64 are operatively engaged with left and right foot pedal wheel tracks 35 for creating an adjustable resistance to the exercise motion of machine 1.

Now referring to FIGS. 1-5, to operate the angle adjustment linkage assembly 50 for adjust the exercise angle of user support frame 10, a user U would complete the follow steps. For example, if user support frame 10 is located in the lowest angle exercise position as illustrated in FIGS. 1 and 3-5 and a user U would like to select a different exercise position such as the highest angle exercise position as illustrated in FIG. 2, user U would stand in front of machine 1 and face machine 1. Next, user U would grasp angle adjustment handle 51 and press down causing angle adjustment lever 52 to pivot about pivot 53 while the second end of angle adjustment lever 52 lifts upward causing locking pin 54 to lift out of the locking pin receiver slots 59 located most proximal to the rearward end of machine 1. Next, user U would pull angle adjustment handle 51 towards user U and towards the forward end of machine 1 causing angle control levers 57 to raise as the first ends of angle control levers 57 pivot about pivot axle 56 in a first direction and the second ends of angle control levers 57 pivot about pivot 58 in a first direction. When locking pin 54 reaches a position directly above the locking pin receiver slots 59 most proximal to the forward end of machine 1, user U would pull up on angle adjustment handle 51 causing angle adjustment lever 52 to pivot about pivot 53 while the second end of angle adjustment lever 52 lowers downward causing locking pin 54 to engage the locking pin receiver slots 59 for securing user support frame 10 to the highest angle exercise position as illustrated in FIG. 2.

To adjust user support frame 10 from this highest angle exercise position to a lower angle exercise position, user U would grasp angle adjustment handle 51 and press down causing angle adjustment lever 52 to pivot about pivot 53 while the second end of angle adjustment lever 52 lifts upward causing locking pin 54 to lift out of the locking pin receiver slots 59 that is located most proximal to the forward end of machine 1. Next, user U would push angle adjustment handle 51 away from user U and towards the rearward end of machine 1 causing angle control levers 57 to lower as the first end of angle control levers 57 pivot about pivot axle 56 in a second direction and the second end of angle control levers 57 pivot about pivot 58 in a second direction. When locking pin 54 reaches a position directly above the desired locking pin receiver slots 59, user U would pull up on angle adjustment handle 51 causing angle adjustment lever 52 to pivot about pivot 53 while the second end of angle adjustment lever 52 lowers causing locking pin 54 to engage the desired locking pin receiver slots 59 for securing user support frame 10 to the desired angle of exercise position.

When user U operates angle adjustment linkage assembly 50 in a first direction to adjust the exercise angle position of user support frame 10, this operation concurrently adjusts the height of left and right gripping handles 41 relative to user support frame 10 in a first direction as follows. When left and right angle control levers 57 raise, the second ends of angle control levers 57 pivot about pivot 58 in a first direction. This causes pivot 49 that is rigidly mounted on pivot 58 to rotate in a first direction. This causes the second end of height control bar 48 to raise as it pivots about pivot 49 in a first direction. This causes the first end of height control bar 48 to raise as it pivots about pivot 47 in a first direction and raise connection tube 9. This causes the second ends of left and right height adjustment levers 45 to pivot about pivot axle 46 in a first direction such that the first ends of height adjustment levers 45 raise and pivot about pivot axle 44 in a first direction to raise left and right mounting tubes 43. This concurrently causes left and right pivotable levers 42, left and right gripping handles 41, and left and right pivots 74 to raise. When left and right pivots 74 raise, this causes the second ends of left and right link bars 72 to raise relative to user support 10 as they pivot about pivots 74 in a first direction and the first ends of link bars 72 to pivot about pivots 75 in a first direction. Raising the height of the left and right gripping handles 41 creates an upper body exercise motion that moves in a more vertical arcing pattern relative to the stationary base frame and the floor surface upon which the stationary base frame rest.

When user U operates angle adjustment linkage assembly 50 in a second direction to adjust the exercise angle position of user support frame 10, this operation concurrently adjusts the height of left and right gripping handles 41 relative to user support frame 10 in a second direction as follows. When left and right angle control levers 57 lower, the second ends of angle control levers 57 pivot about pivot 58 in a second direction. This causes pivot 49 that is rigidly mounted on pivot 58 to rotate in a second direction. This causes the second end of height control bar 48 to lower as it pivots about pivot 49 in a second direction. This causes the first end of height control bar 48 to lower as it pivots about pivot 47 in a second direction and lowers connection tube 9. This causes the second ends of left and right height adjustment levers 45 to pivot about pivot axle 46 in a second direction such that the first ends of height adjustment levers 45 lower and pivot about pivot axle 44 in a second direction to lower left and right mounting tubes 43. This concurrently causes left and right pivotable levers 42, left and right gripping handles 41, and left and right pivots 74 to lower. When left and right pivots 74 lower, this causes the second ends of left and right link bars 72 to lower relative to user support frame 10 as they pivot about pivots 74 in a second direction and the first ends of link bars 72 to pivot about pivots 75 in a second direction. Lowering the height of the left and right gripping handles 41 creates an upper body exercise motion that moves in a more horizontal arcing pattern relative to the stationary base frame and the floor surface upon which the stationary base frame rest.

Machine 1 may be operated with or without an adjustable resistance mechanism 60. FIGS. 1, 3, and 4 illustrate embodiments of machine 1 that comprise an adjustable resistance mechanism 60. To adjust the resistance of adjustable resistance mechanism 60 to increase the resistance to the exercise motion of machine 1, a user U would grasp left or right resistance adjustment knob 62 and rotate resistance knob 62 in a first direction causing resistance adjustment screw 63 to rotate within resistance mounting bracket 61 such that resistance adjustment knob 62 and resistance adjustment screw 63 move downward. This will cause resistance adjustment screw 63 to push downward on resistance friction pad 64, increasing the downward force of resistance friction pad 64 onto foot pedal wheel track 35 and increasing the resistance to the rolling motion of foot pedal transport assembly 30 and the exercise motion of machine 1. To adjust the resistance of adjustable resistance mechanism 60 to decrease the resistance to the exercise motion of machine 1, a user U would grasp left or right resistance adjustment knob 62 and rotate resistance knob 62 in a second direction causing resistance adjustment screw 63 to rotate within resistance mounting bracket 61 such that resistance adjustment knob 62 and resistance adjustment screw 63 move upward. This will cause resistance adjustment screw 63 to pull upward on resistance friction pad 64, decreasing the downward force of resistance friction pad 64 onto foot pedal wheel track 35 and decreasing the resistance to the rolling motion of foot pedal transport assembly 30 and the exercise motion of machine 1.

To operate the exercise motion function of machine 1, user U would enter the machine by placing user U's feet on foot pedals 23 and user U's shins against shin pads 21. User U would then grasp grip handles 41 and concurrently urge the left side lower body user support assembly 20A and left side upper body user support assembly 40A in a pushing or pulling direction while concurrently urging right side lower body user support assembly 20B and right side upper body user support assembly 40B in the opposite direction. This motion causes the first end of left side link bar 25 to move in a first direction as left side pedal transport assembly 30 rolls along left side foot pedal wheel track 35 in a first direction. This causes the second end of left side link bar 25 and the first end of left side link bar 27 to pivot about pivot 26 in a first direction as left side linkage bar 27 swings in a first direction and the second end of left side link bar 27 pivots about left side connection hub 29 in a first direction as left side connection hub pivots about pivot axle 28 in a first direction. This causes left side connection hub flange 71 to rotate in a first direction on left side connection hub 29 and urge left side link bar 73 and left side link bar 72 in a first direction wherein the first end of left side link bar 73 pivots on a rearward portion of left side connection hub flange 71 in a first direction with pivot 76 and the second end of left side linkage bar 73 pivots in a first direction on the left end of rocker arm 80 causing rocker arm 80 to pivot about pivot 81 in a first direction. When urged by left side connection hub flange 71 in a first direction, the first end of left side linkage bar 72 pivots on the forward end of left side connection hub flange 71 in a first direction with a pivot 75 and the second end of left side linkage bar 72 pivots in a first direction on a pivot 74. This causes left side mounting tube 43 to pivot about pivot axle 44 in a first direction causing left side pivotable lever 42 and left side grip handle 41 to move in a first direction.

Rocker arm 80 connects and synchronizes the motion of the left side lower body user support assembly 20A and the left side upper body user support assembly 40A with the motion of the right side lower body user support assembly 20B and right side upper body user support assembly 40B. Therefore, the motion of the left side lower body user support assembly 20A and left side upper body user support assembly 40A in a first direction as previously described herein would cause the first end of right side linkage bar 25 to move in a second direction as right side foot pedal transport assembly 30 rolls along right side foot pedal wheel track 35 in a second direction. This causes the second end of right side link bar 25 and the first end of right side link bar 27 pivot about pivot 26 in a second direction as right side link bar 27 swings in a second direction. This causes the second end of right side linkage bar 27 to pivot about right side connection hub 29 in a second direction as right side connection hub flange 71 pivots about pivot axle 28 in a second direction. This causes right side connection hub flange 71 to rotate in a second direction on right side connection hub 29 and urge right side link bar 73 and right side link bar 72 in second direction. This causes the first end of right side linkage bar 73 to pivot in a second direction on a rearward portion of right side connection hub flange 71 with pivot 76 and the second end of right side link bar 73 to pivot in a second direction on the right end of rocker arm 80 causing rocker arm 80 to pivot about pivot 81 in a second direction. When urged by right side connection hub flange 71 in a second direction, the first end of right side linkage bar 72 pivots in a second direction on a forward portion of right side connection hub flange 71 with a first pivot 75 and the second end of right side linkage bar 72 pivots in a second direction on pivot 74. This causes right side mounting tube 43 to pivot in a second direction about pivot axle 44 causing right side pivotable lever 42 and left side grip handle 41 to move in a second direction.

When user U switches the direction of urging the left side lower body user support assembly 20A and the left side upper body user support assembly 40A from a first direction to a second direction, this causes the direction of the right side lower body user support assembly 20B and the right side upper body user support assembly 40B to switch from a second direction to a first direction and vice versa during the reciprocating operating of machine 1 as previously described herein.

Figure 6:
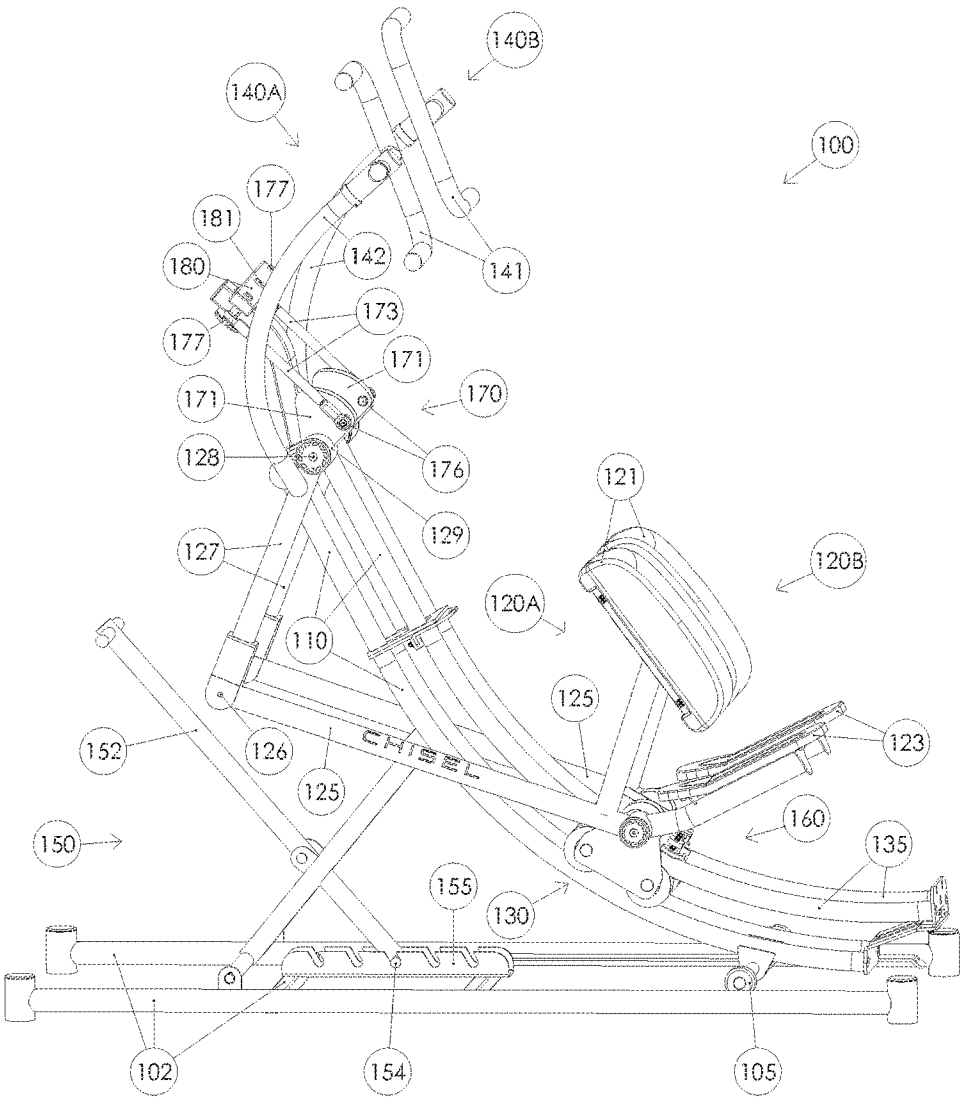
FIG. 6. Is a perspective view of a second embodiment of the invention in a mid-angle exercise position.
Figure 7:
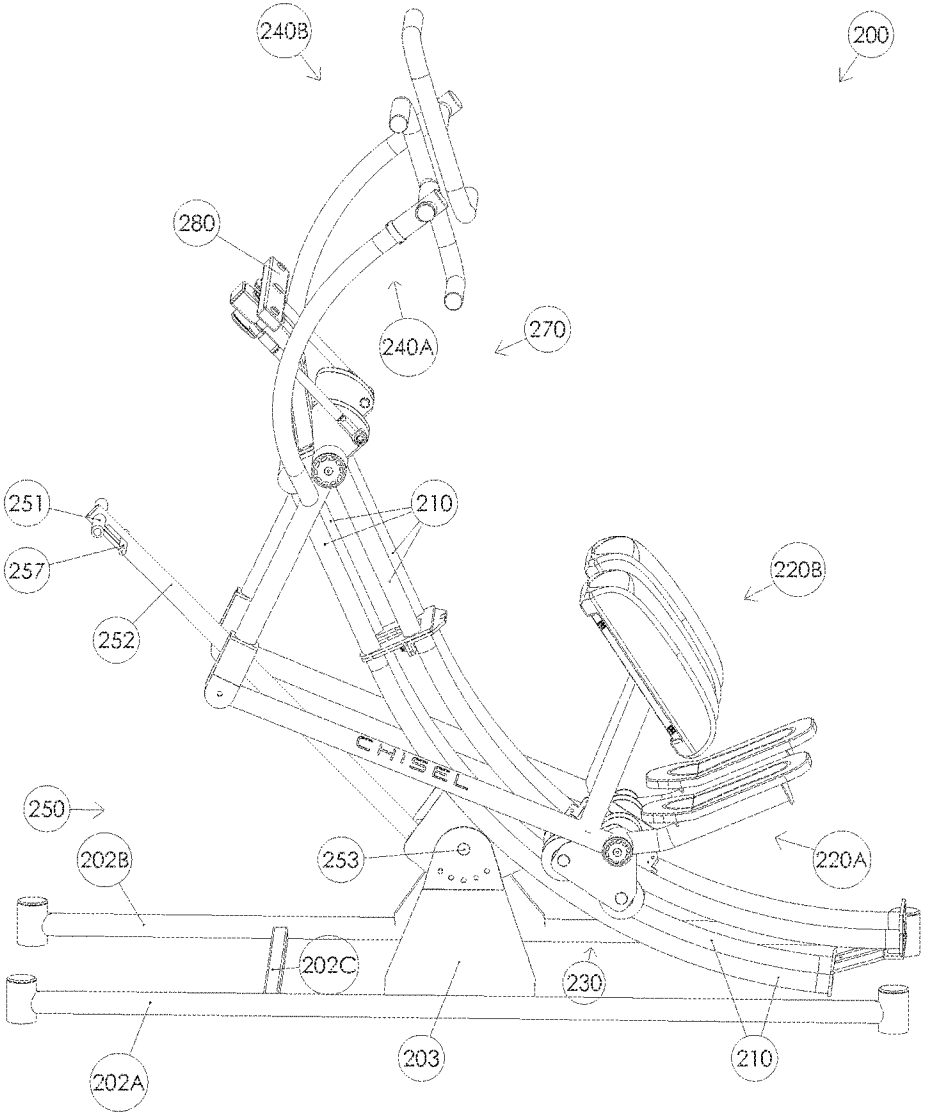
FIG. 7 is a perspective view of a third embodiment of the invention in a highest angle exercise position.
Figure 8:
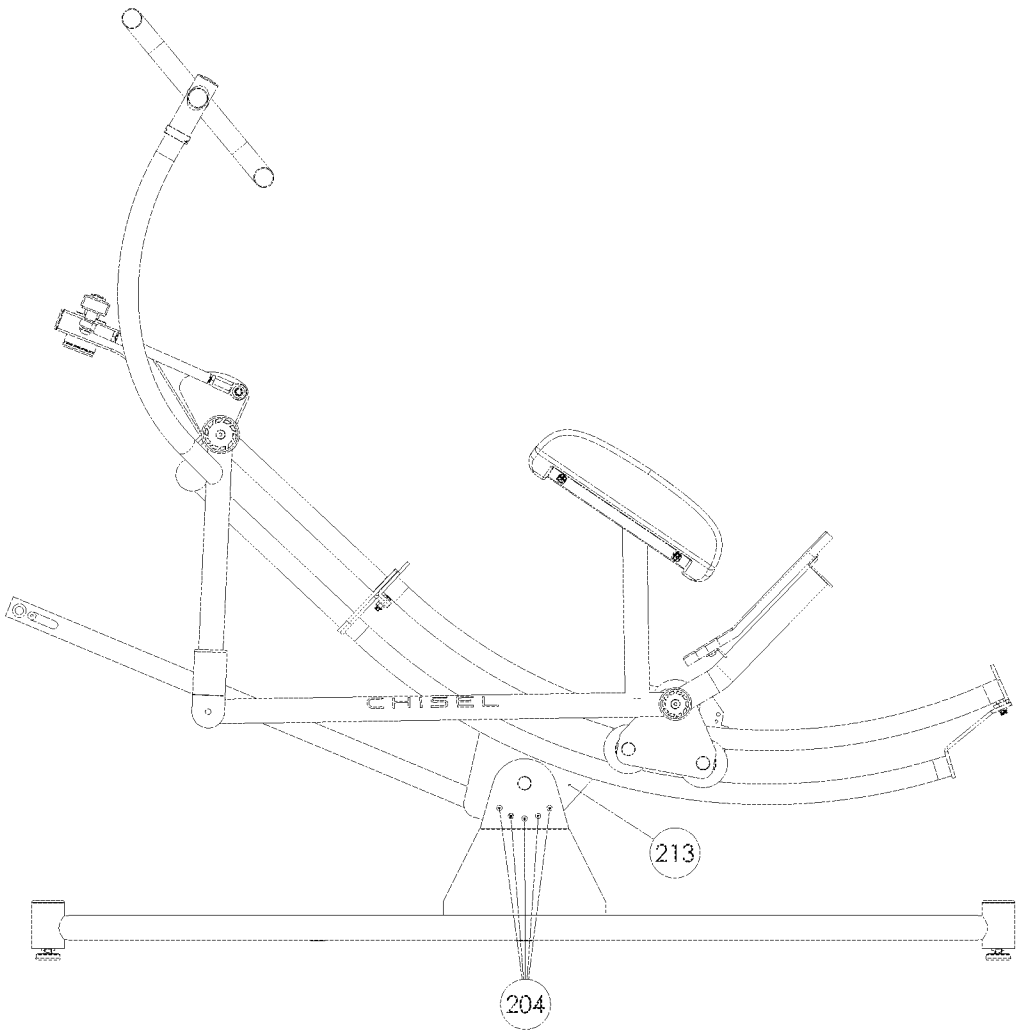
FIG. 8 is a side view of a third embodiment of the invention in a mid-angle exercise position.
Figure 9:
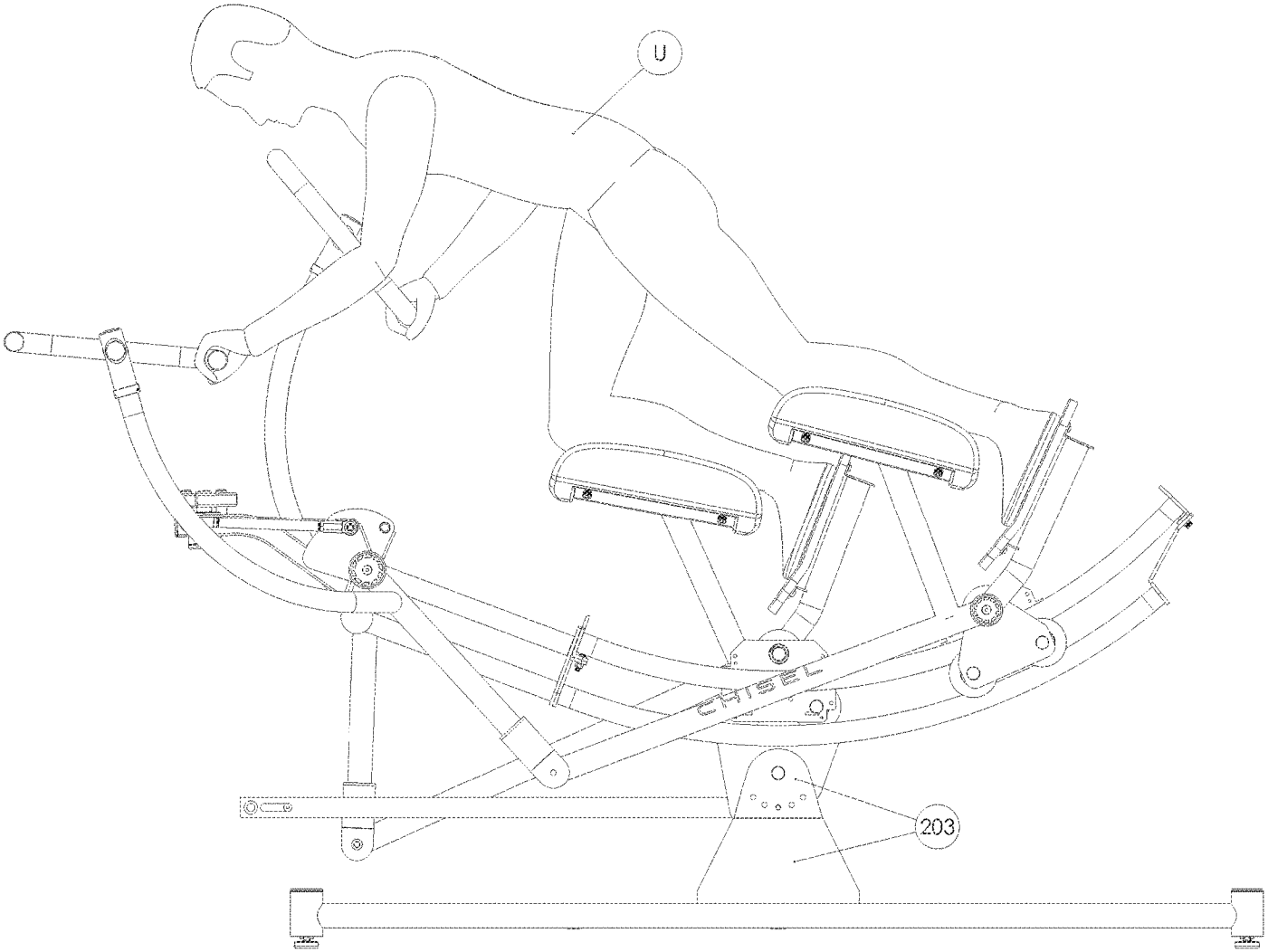
FIG. 9 is a side view of the third embodiment of the invention in a lowest angle exercise position with a user mounted on the machine.

FIG. 6. Illustrates a machine 100 which is a second embodiment of the invention. Machine 100 creates a nearly identical exercise function to the exercise function created by machine 1 but machine 100 is configured with fewer components than machine 1 for reduced manufacturing cost and reduced complexity. The difference in machine 1 and machine 100 is that the upper body user support assembly 140 of machine 100 is not adjustable in height relative to user support 110. The consistencies and differences between machine 1 and machine 100 will be described in detail herein.

As illustrated in FIG. 6, stationary base frame 102 of machine 100 and all of the structural components that are attached to or part of stationary base frame 102 are identical to all of the structural components that are attached to or part of stationary base frame 2 of machine 1 as previously described herein.

As illustrated in FIG. 6, user support frame 110 of machine 100 and all of the structural components that are attached to or part of user support frame 110 are identical to all of the structural components that are attached to or part of user support frame 10 of machine 1 as previously described herein.

As illustrated in FIG. 6, all of the components, functions, and features of angle adjustment assembly 150 of machine 100 are identical to all of the components, functions, and features of angle adjustment assembly 50 of machine 1 as previously described herein.

As illustrated in FIG. 6, all of the components, functions, and features of foot pedal transport assembly 130 of machine 100 are identical to all of the components, functions, and features of foot pedal transport assembly 30 of machine 1 as previously described herein.

As illustrated in FIG. 6, all of the components, functions, and features of lower body user support assembly 120 of machine 100 are identical to all of the components, functions, and features of lower body user support assembly 20 of machine 1 as previously described herein.

As illustrated in FIG. 6, upper body user support assembly 140 of machine 100 is configured with fewer components than upper body user support assembly 40 of machine 1, wherein left and right gripping handles 141 are rigidly connected to first ends of left and right pivotable levers 142 and the second ends of left and right pivotable levers 142 are rigidly connected proximal to the second ends of left and right link bars 129. However, the second ends of left and right pivotable levers 142 could also be rigidly connected to left and right connection hubs 129 to create the identical exercise function of machine 100 as if the second ends of left and right pivotable levers 142 were rigidly connected proximal to the second ends of left and right link bars 129.

As illustrated in FIG. 6, all of the components, functions, and features of rocker arm 180 of machine 100 are identical to all of the components, functions, and features of rocker arm 80 of machine 1 as previously described herein.

As illustrated in FIG. 6, user supports linkage assembly 170 of machine 100 is configured with fewer components than user supports linkage assembly 70 of machine 1 wherein left and right connection hub flanges 171 that are rigidly mounted on left and right connection hubs 129. The first ends of left and right link bars 173 are pivotally connected to the rearward portions of left and right connection hub flanges 171 with left and right pivots 176 and the second ends of left and right link bars 173 are pivotally connected to opposing ends of rocker arm 180 with left and right pivots 177.

As illustrated in FIG. 6, angle adjustment linkage assembly 150 is set at a mid-angle exercise position. To select a new angle of exercise position, user U would operate angle adjustment linkage assembly 150 of machine 100 identically as operating angle adjustment linkage assembly 50 of machine 1 as previously described herein.

As illustrated in FIG. 6, machine 100 is configured with an adjustable resistance assembly 160 and all of the components, functions, and features of adjustable resistance mechanism 160 of machine 100 are identical to all of the components, functions, and features of adjustable resistance mechanism 60 of machine 1 as previously described herein. However, machine 100 can also function without adjustable resistance mechanism 160 for lower exertion exercising, physical therapy, and stretching.

To operate the exercise motion function of machine 100, user U would enter the machine by placing user U's feet on foot pedals 123 and user U's shins against shin pads 121. User U would then grasp grip handles 141 and concurrently urge the left side lower body user support assembly 120A and left side upper body user support assembly 140A in a pushing or pulling direction while concurrently urging right side lower body user support assembly 120B and right side upper body user support assembly 140B in the opposite direction. This motion would cause the first end of left side link bar 125 to move in a first direction as left side pedal transport assembly 130 rolls along left side foot pedal wheel track 135 in a first direction. This causes the second end of left side link bar 125 and the first end of left side link bar 127 to pivot about pivot 126 in a first direction as left side linkage bar 127 swings in a first direction and the second end of left side link bar 127 pivots about left side connection hub 129 in a first direction. This concurrently causes left side pivotable lever 142 and left side gripping handle 141 to pivot in a first direction as left side connection hub 129 pivots about pivot axle 128 in a first direction. This causes left side connection hub flange 171 to rotate in a first direction on left side connection hub 129 and urge left side link bar 173 in a first direction such that the first end of left side link bar 173 pivots on a rearward portion of left side connection hub flange 171 in a first direction with pivot 176 and the second end of left side linkage bar 173 pivots in a first direction on the left end of rocker arm 180 with pivot 177 causing rocker arm 180 to pivot about pivot 181 in a first direction.

Rocker arm 180 connects and synchronizes the motion of the left side lower body user support assembly 120A and the left side upper body user support assembly 140A with the motion of the right side lower body user support assembly 120B and right side upper body user support assembly 140B. Therefore, the motion of the left side lower body user support assembly 120A and left side upper body user support assembly 140A in a first direction as previously described herein would cause the first end of right side linkage bar 125 to move in a second direction as right side foot pedal transport assembly 130 rolls along right side foot pedal wheel track 135 in a second direction. This causes the second end of right side link bar 125 and the first end of right side link bar 127 pivot about pivot 126 in a second direction as right side link bar 127 swings in a second direction and the second end of right side linkage bar 127 pivots about right side connection hub 129 in a second direction. This causes right side pivotable lever 142 and right side gripping handle 141 to pivot in a second direction as right side connection hub 129 pivots about pivot axle 128 in a second direction. This causes right side connection hub flange 171 to rotate in a second direction on right side connection hub 129 and urge right side link bar 173 in a second direction wherein the first end of right side link bar 173 pivots on a rearward portion of right side connection hub flange 171 in a second direction with pivot 176 and the second end of right side linkage bar 173 pivots in a second direction with pivot 177 on the right end of rocker arm 180 causing rocker arm 180 to pivot about pivot 181 in a second direction.

When user U switches the direction of urging the left side lower body user support assembly 120A and the left side upper body user support assembly 140A from a first direction to a second direction, this causes the direction of the right side lower body user support assembly 120B and the right side upper body user support assembly 140B to switch from a second direction to a first direction and vice versa during the reciprocating operating of machine 100 as previously described herein.

FIGS. 7-13 Illustrates a machine 200 which is a third embodiment of the invention. Machine 200 creates an identical exercise function to the exercise function created by machine 100 but machine 200 is configured with a different angle adjustment assembly 250 than the angle adjustment assembly 150 of machine 100. The consistencies and differences between machine 100 and machine 200 will be described in detail herein.

As best illustrated in FIGS. 7-10 and 13, stationary base frame 202 is represented as a rectangular shaped structure made of elongated rigid left and right side tubes 202A, 202B that span the long side of the structure. The center and forward portions of the side tubes 202A, 202B are joined and braced across the narrower width with rigid cross tubes 202C. Left and right side machine user support frame pivot mounting brackets 203 are rigidly connected to the central portion of the long side left and right side tubes 202A, 202B of stationary base frame 202. The user support frame pivot mounting brackets 203 could be constructed of various shapes but are represented as mostly triangular shaped bent plates with a pivot axle receiver hole near the upper end for receiving a pivot axle 253. An arc shaped pattern of receiver holes 204 are arranged below the pivot axle receiver hole on user support frame pivot mounting bracket 203. Stationary base frame 202 can be configured differently as long as it is capable of supporting the weight and function of machine 200 plus a user U.

As illustrated in FIGS. 7-10 and 13 user support frame 210 of machine 200 is constructed identically to the user support frame 110 of machine 100 as previously described herein with the exception that that left and right pivot connection plates 213 have been added to the lower central portion of user support frame 210.

Figure 10:
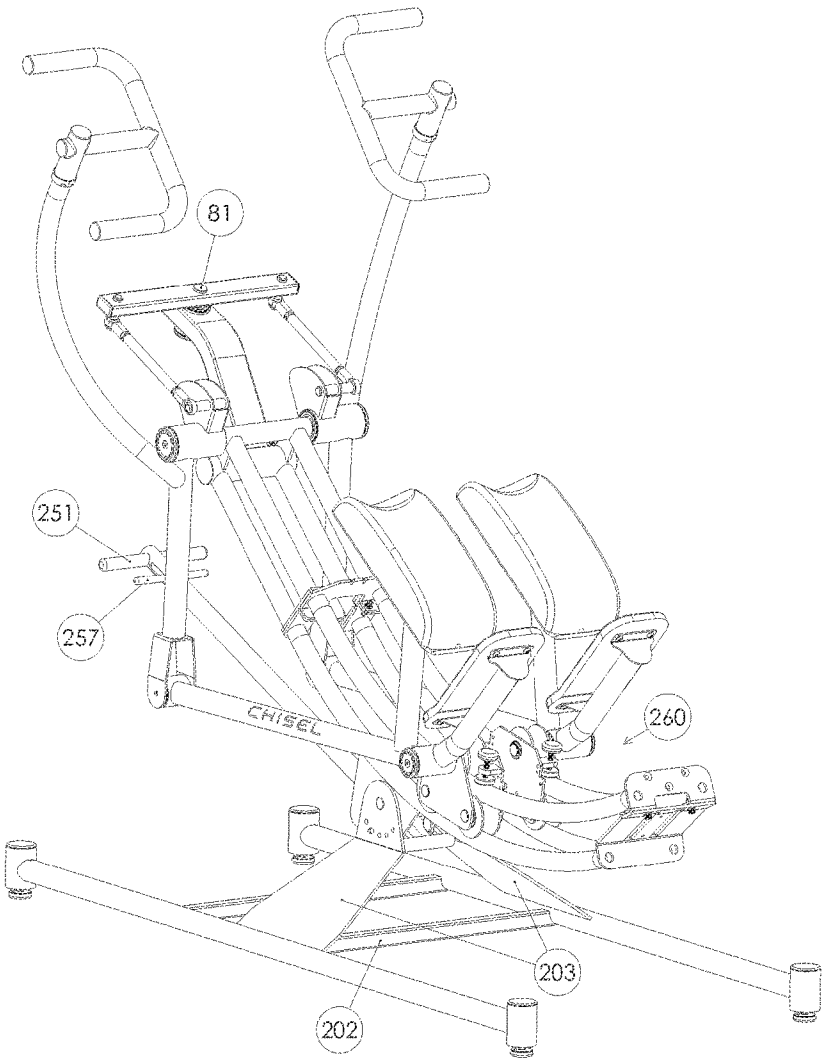
FIG. 10 is a perspective view of the third embodiment of the invention in a mid-angle exercise position.
Figure 11:
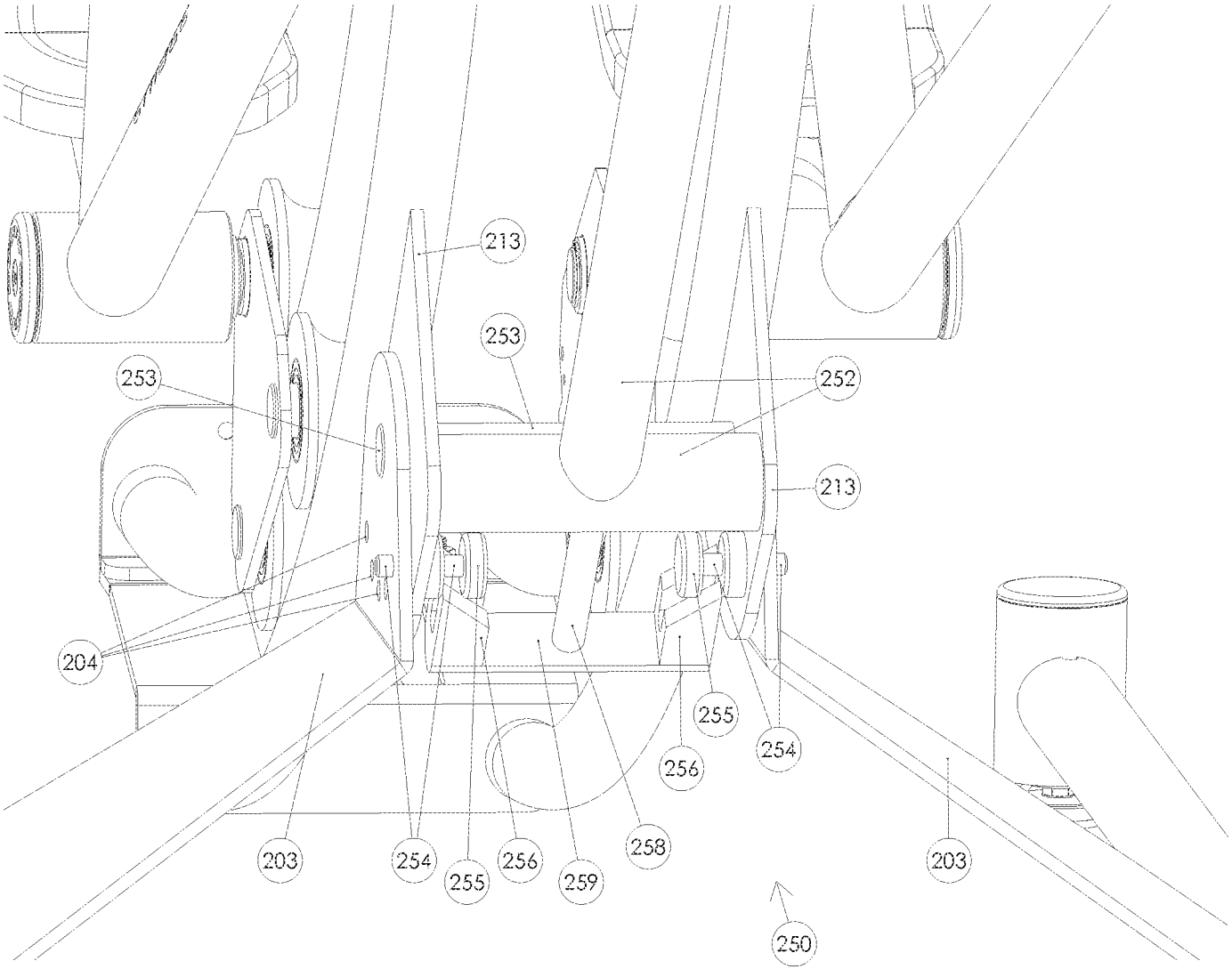
FIG. 11 is a close up view of the angle adjustment linkage assembly of the third embodiment of the invention wherein the angle adjustment linkage assembly is in the latched configuration.
Figure 12:
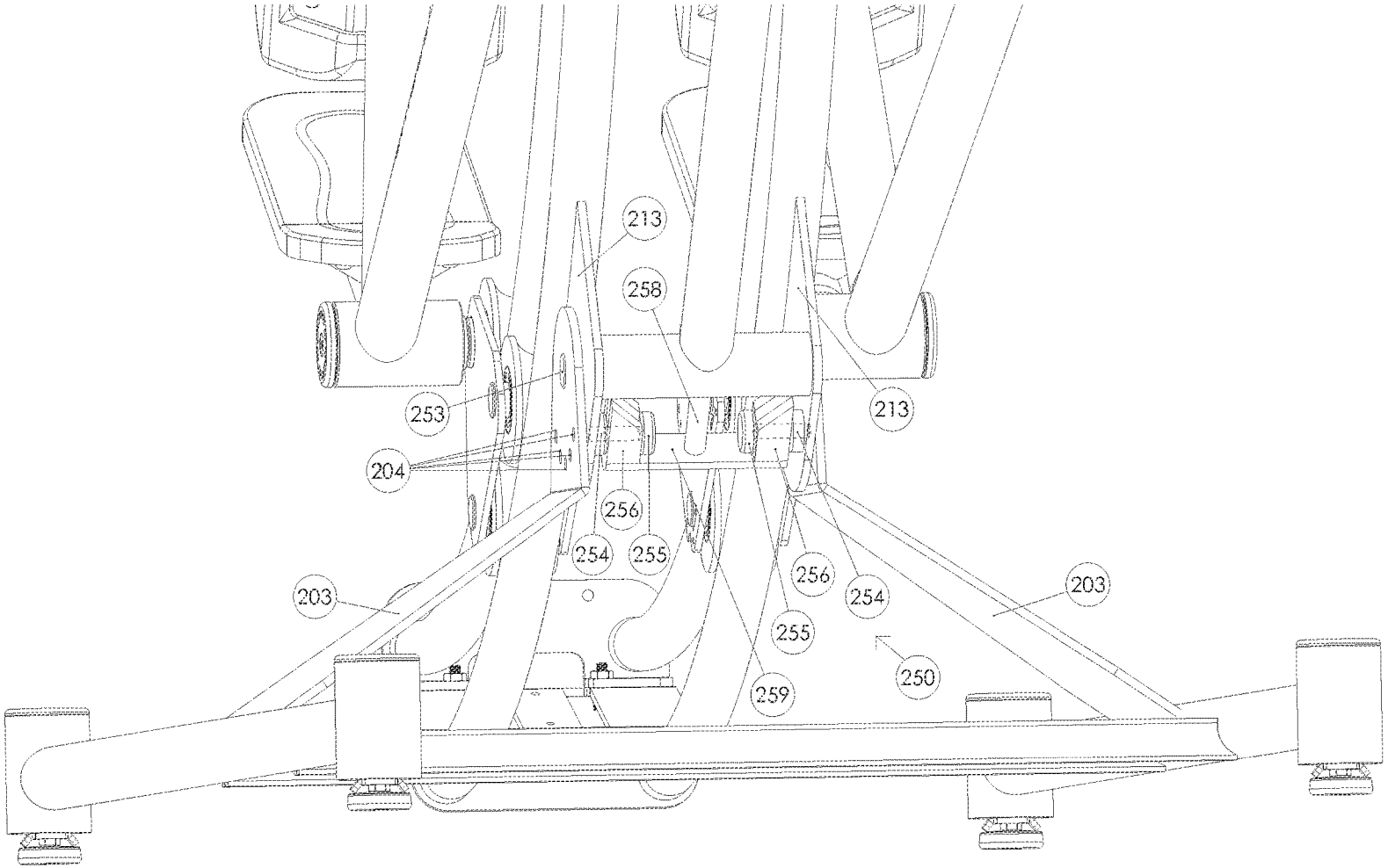
FIG. 12 is a close up view of the angle adjustment linkage assembly of the third embodiment of the invention wherein the angle adjustment linkage assembly is in the unlatched configuration.
Figure 13:
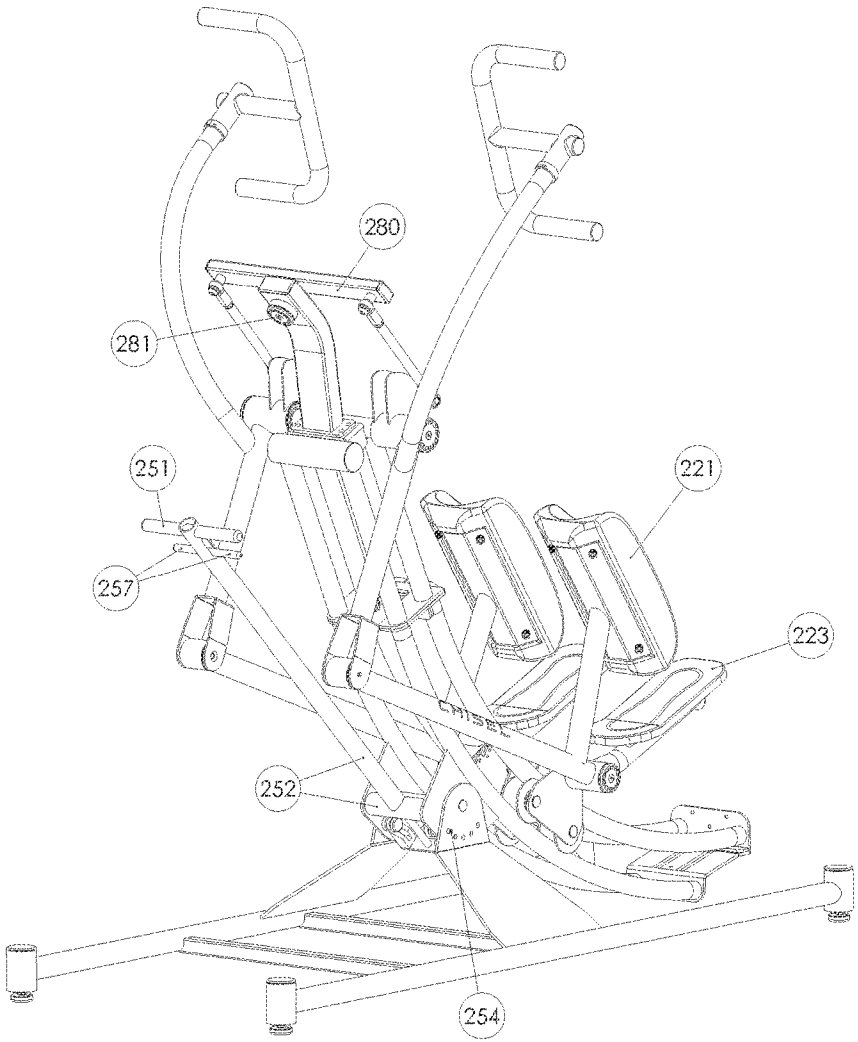
FIG. 13 is a perspective view of the third embodiment of the invention in a highest angle exercise position.

FIGS. 7-13 illustrate angle adjustment assembly 250. FIGS. 11 and 12 illustrate close up views of the components not fully visible from the whole machine 200 views. Angle adjustment assembly 250 is comprised of left and right pivot connection plates 213 that are rigidly connected to a lower central portion of user support frame 210. A pivot axle 253 passes through the left side user support frame pivot mounting bracket 203, the left side pivot connection plate 213, the right side pivot connection plate 213, and the right side user support frame pivot mounting bracket 203 so as to pivotally joint user support frame 210 with stationary base frame 202. Left and right spring loaded locking pins 254 are operatively connected at a perpendicular angle to the inside walls of left and right pivot connection plates 213. A disengagement knob 255 is rigidly connected to a first end of spring loaded locking pins 254 and an internal portion of spring loaded locking pins 254 contains a compression spring for urging spring loaded locking pins 254 to an extended position. The second end of each spring loaded locking pin 254 extends through pivot connection plate 213 and through a receiver hole 204 located on user support frame pivot mounting bracket 203 when spring loaded locking pin 254 is in the extended position. When spring loaded locking pins 254 are in the contracted position, the second ends of spring loaded locking pins 254 only extend through pivot connection plates 213 and do not extend into a receiver holes 204.

A gripping handle 251 is rigidly connected to a first end of an angle adjustment lever 252 tube. Angle adjustment lever 252 is an elongated hollow tube with a cross tube rigidly connected to the second end of angle adjustment lever 252 such that the second end of angle adjustment lever 252 is T shaped. Opposing ends of the cross tube portion of angle adjustment lever 252 are rigidly connected to the inside walls of left and right pivot connection plates 213 at a location adjacent to spring loaded locking pins 254. An actuator lever trigger 257 is operatively engaged with the angle adjustment lever 252 at a location adjacent to gripping handle 251 such that a user U can grasp gripping handle 251 and reach actuator lever trigger 257 by extending user U's fingers. Actuator lever trigger 257 passes through left and right elongated slots in angle adjustment lever 252 at a perpendicular angle. The first end of an elongated actuator lever 258 is rigidly connected to actuator lever trigger 257 in a T shaped configuration. Actuator lever 258 is slidably engaged with the inside of angle adjustment lever 252 such that actuator lever 258 extends from actuator lever trigger 257 through the second end of angle adjustment lever 252 and extends a few inches beyond the second end of angle adjustment lever 252. The second end of actuator lever 258 is rigidly connected to a central portion of a ramps mounting plate 259 to form a T shape.

Ramps mounting plate 259 extends most of the distance between the inside walls of left and right pivot connection plates 213. A left and right actuator ramp 256 is rigidly connected to opposing ends of ramps mounting plate 259 and operatively engaged with left and right spring loaded locking pins 254. Actuator ramps 256 are wedge shaped components with a central slot for accepting spring loaded locking pins 254. Actuator ramps 256 are preferably constructed from low friction material.

As illustrated in FIGS. 7-10 and 13 all of the components, functions, and features of foot pedal transport assembly 230 of machine 200 are identical to all of the components, functions, and features of foot pedal transport assembly 130 of machine 100 as previously described herein.

As illustrated in FIGS. 7-10 and 13 all of the components, functions, and features of lower body user support assembly 220 of machine 200 are identical to all of the components, functions, and features of lower body user support assembly 120 of machine 100 as previously described herein.

As illustrated in FIGS. 7-10 and 13 all of the components, functions, and features of upper body user support assembly 240 of machine 200 are identical to all of the components, functions, and features of upper body user support assembly 140 of machine 100 as previously described herein.

As illustrated in FIGS. 7-10 and 13 all of the components, functions, and features of rocker arm 280 of machine 200 are identical to all of the components, functions, and features of rocker arm 180 of machine 100 as previously described herein.

As illustrated in FIGS. 7-10 and 13 all of the components, functions, and features of user supports linkage assembly 270 of machine 200 are identical to all of the components, functions, and features of user supports linkage assembly 170 of machine 100 as previously described herein.

As illustrated in FIG. 10, machine 200 can configured with an adjustable resistance mechanism 260 and all of the components, functions, and features of adjustable resistance mechanism 260 of machine 200 are identical to all of the components, functions, and features of adjustable resistance mechanism 160 of machine 100 as previously described herein. However, as illustrated in FIGS. 7-9 and 13 machine 200 can be configured without adjustable resistance mechanism 260 for lower exertion exercising, physical therapy and stretching.

To adjust the angle of exercise position of machine 200, a user U would stand in front of machine 200 and face machine 200. User U would then grasp gripping handle 251 with user U's palm and extend user U's fingers to grasp actuator lever trigger 257. User U would then squeeze actuator lever trigger 257 into a contracted position so as to draw actuator lever trigger 257 and actuator lever 258 towards gripping handle 251. This would cause left and right actuator ramps 256 to move towards spring loaded locking pin 254 to move left and right disengagement knobs 255 towards actuator lever 258 to contract the second ends of spring loaded locking pins 254 so as to draw the second end of spring loaded locking pins out of receiver holes 204. This would unlock user support frame 210 from user support frame pivot mounting bracket 203 such that user support frame 210 can rotate about pivot axle 253. While user U is grasping and maintaining actuator lever trigger 257 in the contracted position, user U can move angle adjustment lever 252 upward to move user support frame 210 to a higher angle of exercise position or user U can move angle adjustment lever 252 downward to move user support frame 210 to a lower angle of exercise position. When user U moves user support frame 210 to a desired angle of exercise position, user U will release user U's grasp on actuator trigger 257 so that actuator lever 258 will move away from gripping handle 251 and left and right actuator ramps 256 will move away from spring loaded locking pin 254 to move left and right disengagement knobs 255 away from actuator lever 258 to extend the second ends of spring loaded locking pins 254 so as to engage the second end of spring loaded locking pins with a receiver holes 204 to lock user support frame 210 into a desired angle of exercise position.

The adjustable resistance mechanism 260 of machine 200 operates identically to adjustable resistance mechanism 160 of machine 100. Therefore, to operate the adjustable resistance assembly 260 of machine 200, a user U would follow the identical steps for operating the adjustable resistance mechanism 160 of machine 100 as previously described herein.

The exercise motion function of machine 200 is identical to that of the exercise motion function of machine 100. Therefore, to operate the exercise function of machine 200, a user U would follow the identical steps for operating the exercise motion function of machine 100 as previously described herein.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

REFERENCE NUMERALS

U User
1 Machine
2 Stationary base frame
3 Linear wheel track
5 Axle mounting flange
7 Axle mounting flange
9 Connection tube
10 User support frame
11 Connection bracket
12 Axle connection plate
14 Axle
15 Angle adjustment wheel
20 Lower body user support assembly
20A Left side lower body user support assembly
20B Right side lower body user support assembly
21 Shin pad
22 Shin pad support tube
23 Foot pedal
24 Foot pedal support tube
25 Link bar
26 Pivot
27 Link bar
28 Pivot axle
29 Connection hub
30 Foot pedals transport assembly
31 Housing
32 Foot pedal wheel
33 Pivot hub
34 Pivot hub axle
35 Foot pedal wheel track
40 Upper body user support assembly
40A Left side upper body user support assembly
40B Right side upper body user support assembly
41 Gripping handle
42 Pivotable lever
43 Mounting tube
44 Pivot axle
45 Height adjustment lever
46 Pivot axle
47 Pivot
48 Height control bar
49 Pivot
50 Angle adjustment linkage assembly
51 Angle Adjustment handle
52 Angle adjustment lever
53 Pivot axle
54 Locking pin
55 Locking rack
56 Pivot axle
57 Angle control lever
58 Pivot
59 Locking pin receiver slot
60 Adjustable resistance mechanism
61 Resistance mounting bracket
62 Resistance adjustment knob
63 Resistance adjustment screw
64 Resistance friction pad
70 User supports linkage assembly
71 Connection hub flange
72 Link bar
73 Link bar
74 Pivot
75 Pivot
76 Pivot
77 Pivot
80 Rocker arm
81 Rocker arm pivot
82 Rocker arm support tube
100 Machine
110 User support frame
102 Stationary base frame
120 Lower body user support assembly
120A Left side lower body user support assembly
120B Right side lower body user support assembly
127 Link bar
129 Connection hub
130 Foot pedal transport assembly
140 Upper body user support assembly
140A Left side upper body user support assembly
140B Right side upper body user support assembly
141 Gripping handle
142 Pivotable lever
150 Angle adjustment linkage assembly
152 Angle adjustment lever
154 Locking pin
155 Locking pin rack
160 Adjustable resistance mechanism
170 User supports linkage assembly
171 Linkages connection hub
173 Link bar
176 Pivot
177 Pivot
180 Rocker arm
181 Rocker arm pivot
200 Machine
202 Stationary base frame
203 User support frame pivot mounting bracket
204 Receiver hole
210 User support frame
213 Pivot connection plate
220 Lower body user support assembly
220A Left side lower body user support assembly
220B Right side lower body user support assembly
221 Shin pad
223 Foot pedal
230 Foot pedal transport assembly
240 Upper body user support assembly
240A Left side upper body user support assembly
240B Right side upper body user support assembly
250 Angle adjustment linkage assembly
251 Gripping handle
252 Angle adjustment lever
253 Pivot axle
254 Spring loaded locking pin
255 Disengagement knob
256 Actuator ramp
257 Actuator lever trigger
258 Actuator lever
259 Actuator ramps mounting plate
260 Adjustable resistance mechanism
270 User supports linkage assembly

What is claimed is:

1. An upper and lower body reciprocating arcing motion exercise machine with an adjustable angle user support frame comprising:

a) a stationary base frame having a forward end, a rearward end, and a central portion located between the forward end and the rearward end;

b) a user support frame having a forward end and a rearward end, with a rearward portion of the user support frame being slidably or rollably engaged with the rearward and central portion of the stationary base frame;

c) an angle adjustment linkage assembly pivotally mounted on a forward portion of the stationary base frame and pivotally connected to the forward portion of the user support frame for adjusting the angle of the user support frame relative to the stationary base frame and floor surface upon which the stationary base frame rests;

d) a left side lower body user support assembly comprising a foot pedal and a shin pad, the left side lower body support assembly being operatively connected to the user support frame for movement in a reciprocating arcing motion between the rearward portion of the user support frame and the central portion of the user support frame, and a right side lower body user support assembly comprising a foot pedal and a shin pad, the right side lower body support assembly being operatively connected to the user support frame for movement in a reciprocating arcing motion between the rearward portion of the user support frame and the central portion of the user support frame;

e) a left side upper body user support assembly comprising a gripping handle and a pivotable lever, the left side upper body user support assembly being operatively connected to the user support frame for movement in a reciprocating arcing motion between the forward portion of the user support frame and the central portion of the user support frame, and a right side upper body user support assembly comprising a gripping handle and a pivotable lever, the right side upper body user support assembly being operatively connected to the user support frame for movement in a reciprocating arcing motion between the forward portion of the user support frame and the central portion of the user support frame;

f) a left side user supports linkage assembly operatively connecting the left side upper body user support assembly to the left side lower body user support assembly at a left side connection hub, and a right side user supports linkage assembly operatively connecting the right side upper body user support assembly to the right side lower body user support assembly at a right side connection hub; and g) a rocker arm pivotably mounted on the user support frame, wherein the left side connection hub and the right side connection hub are operatively connected to opposing ends of the rocker arm such that the motions of the left side upper body user support assembly and the left side lower body user support assembly are synchronized with the opposing motions of the right side upper body user support assembly and the right side lower body user support assembly.

2. The exercise machine of claim 1, further comprising a left side pedal transport assembly that moves in an arc shaped path along the user support frame and a right side pedal transport assembly that moves in an arc shaped path along the user support frame.

3. The exercise machine of claim 2, further comprising left and right pivoting levers and at least one common height adjustment lever, wherein the gripping handles of the left side and right side upper body user support assemblies are respectively mounted on the left and right pivoting levers, the left and right pivoting levers being independently pivotably mounted on a first end or a central portion of the at least one common height adjustment lever, and a second end of the at least one common single height adjustment lever is pivotally mounted on the user support frame.

4. The exercise machine of claim 3, wherein the at least one common height adjustment lever is operatively connected to a height adjustment link bar such that anytime the angle adjustment linkage assembly is adjusted so as to adjust the angle of the user support frame, the height adjustment link bar concurrently adjusts the angle of the at least one common height adjustment lever relative to the user support frame.

5. The exercise machine of claim 4, wherein a reciprocating arcing pattern of exercise motion is defined by the configuration of the left side and right side upper body user support assemblies, the left side and right side lower body user support assemblies, the left side and right side user supports linkage assemblies, and the rocker arm, and wherein a range of movement of the reciprocating arcing pattern of exercise motion is controlled by a range of movement of exercise motion of a user.

6. The exercise machine of claim 5, further comprising an adjustable resistance mechanism that is operatively engaged with the exercise motion of the left side upper body user support assembly, the right side upper body user support assembly, the left side lower body user support assembly, and the right side lower body user support assembly.

7. An upper and lower body reciprocating arcing motion exercise machine with an adjustable angle user support frame comprising:

a) a stationary base frame having a forward end, a rearward end, and a central portion located between the forward end and the rearward end;

b) a user support frame having a forward end and a rearward end, with a rearward portion of the rearward end of the user support frame being slidably or rollably engaged with the rearward end and central portion of the stationary base frame;

c) an angle adjustment linkage assembly pivotally mounted on a forward portion of the stationary base frame and pivotally connected to a forward portion of the user support frame for adjusting the angle of the user support frame relative to the stationary base frame and floor surface upon which the stationary base frame rest;

d) a left side lower body user support assembly comprising a foot pedal and a shin pad, the left side lower body support assembly being operatively connected to the user support frame for movement in a reciprocating arcing motion between the rearward portion of the user support frame and the central portion of the user support frame, and a right side lower body user support assembly comprising a foot pedal and a shin pad, the right side lower body support assembly being operatively connected to the user support frame for movement in a reciprocating arcing motion between the rearward portion of the user support frame and the central portion of the user support frame;

e) a left side upper body user support comprising a gripping handle connected to a first end of a left side pivotable lever and a second end of the left side pivotable lever being rigidly connected to the left side lower body user support assembly for movement in a reciprocating arcing motion between the forward portion of the user support frame and the central portion of the user support frame, and a right side upper body user support comprising a gripping handle connected to a first end of a right side pivotable lever and a second end of the right side pivotable lever being rigidly connected to the right side lower body user support assembly for movement in a reciprocating arcing motion between the forward portion of the user support frame and the central portion of the user support frame;

f) a left side connection hub connecting the left side lower body user support assembly to the user support frame and a right side connection hub connecting the right side lower body user support assembly to the user support frame;

f) a rocker arm pivotably mounted on the user support frame; and g) a left side link bar operatively connecting a left end of the rocker arm to the left side connection hub and a right side link bar operatively connecting a right end of the rocker arm to the right side connection hub such that the motions of the left side upper body user support assembly and the left side lower body user support assembly are synchronized with the opposing motions of the right side upper body user support assembly and the right side lower body user support assembly.

8. The exercise machine of claim 7, further comprising a left side pedal transport assembly that moves along in an arc shaped path along the user support frame and a right side pedal transport assembly that moves along in an arc shaped path along the user support frame.

9. The exercise machine of claim 8, wherein a reciprocating arcing pattern of exercise motion is defined by the configuration of the left side upper body user support assembly, the right side upper body user support assembly, the left side lower body user support assembly, the right side lower body user support assembly, the left side link bar, the right side link bar, and the rocker arm, and wherein a range of movement of the reciprocating arcing pattern of exercise motion is controlled by a range of movement of exercise motion of a user.

10. The exercise machine of claim 9, further comprising an adjustable resistance mechanism that is operatively engaged with the exercise motion of the left side upper body user support assembly, the right side upper body user support assembly, the left side lower body user support assembly, and the right side lower body user support assembly.

11. An upper and lower body reciprocating arcing motion exercise machine with an adjustable angle user support frame comprising:

a) a stationary base frame having a forward end, a rearward end, and a central portion located between the forward end and the rearward end;

b) a user support frame having a forward end, a rearward end, and a central portion located between the forward end and the rearward end of the user support frame, with the central portion of the user support frame being pivotally mounted on the stationary base frame;

c) an angle adjustment assembly operatively connecting the central portion of the user support frame with the stationary base frame for adjusting the angle of the user support frame relative to the stationary base frame and floor surface upon which the stationary base frame rests;

d) a left side lower body user support assembly comprising a foot pedal and a shin pad, the left side lower body support assembly being operatively connected to the user support frame for movement in a reciprocating arcing motion between the rearward portion of the user support frame and the central portion of the user support frame, and a right side lower body user support assembly comprising a foot pedal and a shin pad, the right side lower body support assembly being operatively connected to the user support frame for movement in a reciprocating arcing motion between the rearward portion of the user support frame and the central portion of the user support frame;

e) a left side upper body user support comprising a gripping handle connected to a first end of a left side pivotable lever and a second end of the left side pivotable lever being rigidly connected to the left side lower body user support assembly for movement in a reciprocating arcing motion between the forward portion of the user support frame and the central portion of the user support frame, and a right side upper body user support comprising a gripping handle connected to a first end of a right side pivotable lever and a second end of the right side pivotable lever being rigidly connected to the right side lower body user support assembly for movement in a reciprocating arcing motion between the forward portion of the user support frame and the central portion of the user support frame;

f) a left side connection hub connected the left side lower body user support assembly to the user support frame and a right side connection hub connecting the right side lower body user support assembly to the user support frame;

f) a rocker arm pivotably mounted on the user support frame; and g) a left side link bar operatively connecting a left end of the rocker arm to the left side connection hub and a right side link bar operatively connecting a right end of the rocker arm to the right side connection hub such that the motions of the left side upper body user support assembly and the left side lower body user support assembly are synchronized with the opposing motions of the right side upper body user support assembly and the right side lower body user support assembly.

12. The exercise machine of claim 11, further comprising a left side pedal transport assembly that moves along in an arc shaped path along the user support frame and a right side pedal transport assembly that moves in an arc shaped path along the user support frame.

13. The exercise machine of claim 8, wherein a reciprocating arcing pattern of exercise motion is defined by the configuration of the left side upper body user support assembly, the right side upper body user support assembly, the left side lower body user support assembly, the right side lower body user support assembly, the left side link bar, the right side link bar, and the rocker arm, and wherein a range of movement of the reciprocating arcing pattern of exercise motion is controlled by a range of movement of exercise motion of a user.

14. The exercise machine of claim 13, further comprising an adjustable resistance mechanism that is operatively engaged with the exercise motion of the left side upper body user support assembly, the right side upper body user support assembly, the left side lower body user support assembly, and the right side lower body user support assembly.

* * * * *